US005989458A

United States Patent [19]

Fujinami et al.

[11] Patent Number: 5,989,458

[45] Date of Patent: Nov. 23, 1999

[54] CONDUCTIVE MATERIALS AND THEIR COMPOSITIONS

[75] Inventors: Tatsuo Fujinami; Hiroshi Iizuka; Takitaro Yamaguchi; Mamoru Katsumata; Masatoshi Kishida; Hideaki Kamohara, all of Shizuoka, Japan

[73] Assignee: Yazaki Corporation, Tokyo, Japan

[21] Appl. No.: 09/062,583

[22] Filed: Apr. 20, 1998

[30] Foreign Application Priority Data

Jun. 6, 1997 [JP] Japan ..... 9-149784

[51] Int. Cl.[6] ..... H01B 1/06; H01B 1/20

[52] U.S. Cl. ..... 252/500

[58] Field of Search ..... 252/509, 511, 252/519.2, 519.31, 508, 500; 210/679; 524/405, 413, 442, 430, 450; 106/632, 431, 626; 523/466, 521

[56] References Cited

U.S. PATENT DOCUMENTS 4,822,492 4/1989 Chao et al. ..... 210/679

5,171,365 12/1992 Watson ..... 160/632

FOREIGN PATENT DOCUMENTS 8-259698 10/1996 Japan .

8-301879 11/1996 Japan .

OTHER PUBLICATIONS

M. Watanabe et al., "Properties of Polymer Electrolytes Complexed with New Lithium Salt", 35th Review Conference of Cells, pp. 213–214 (1994).

G. Rawsky et al., "Aluminosilicate/Poly(ethylene glycol) Copolymers: A New Class of Polyelectrolytes", Chemistry of Materials, 12(6) :2208 (1994) .

*Primary Examiner*—Mark Kopec

*Assistant Examiner*—Derrick G. Hamlin

*Attorney, Agent, or Firm*—Finnegan, Henderson, Farabow, Garrett & Dunner, L.L.P.

[57] ABSTRACT

The present invention provides conductive materials having high ionic conductivity and cationic transference number, small amount of polarization and good flexibility. The conductive material comprises high molecular compounds and alkalisiloxyaluminate.

8 Claims, 21 Drawing Sheets

CONDUCTIVE MATERIALS AND THEIR COMPOSITIONS

FIELD OF THE INVENTION

The present invention relates to conductive materials to be used for nonaqueous secondary cells.

BACKGROUND OF THE INVENTION

Cells using alkaline metal and the like as an electrode have been used in a variety of fields because high voltages can be obtained from them.

These cells ordinarily use a nonaqueous solvent in which a low molecular weight salt of a metal is solved as a liquid electrolyte. There is, however, the fear of leakage of liquid electrolytes and, in order to prevent such leakage, it is necessary to house a main portion of a cell in a solid can, as a result, imposing limitations on design of cell configurations. Thus, a solid electrolyte is expected so that above-mentioned defects can be overcome and cells with free configurations can be designed.

Under such a circumstance, the solid electrolyte, in particular, a high molecular solid electrolyte to obtain a flexible solid Electrolyte has been investigated. The flexibility of solid electrolytes is required for following reasons, i.e., any solid electrolyte having no flexibility is not applicable to cylindrical cells fabricated by spirally winding cells comprising a zonal electrode and electrolyte, and it is difficult to make a capacity of a cell larger.

Such a high molecular solid electrolyte is a kind of solid solution in which a low molecular weight salt of a metal has been solved in high molecular substances such as polyethylene oxide. However, the polyethylene oxide high molecular solid electrolyte is inevitably an amphoteric ionic conductor which allows migration of both an anion and cation, causing a large amount of polarization at the time of application of voltages.

The migration of anions raises problems which exert adverse effects on characteristics of a cell; for example, when carbon materials are used as a negative electrode, anions are intercalated together with lithium, causing breakage of carbon crystal structures, or the migrated anions react electrochemically with both positive and negative electrodes, exerting bad influences on the characteristics of the cell.

One example of such high molecular solid electrolytes was reported in the preparatory manuscript collection (p213–214) of the 35th Review Conference of Cells in 1994. The disclosed high molecular solid electrolyte therein was a substance obtained by solving $LiN(SO_2CF_3)_2$, an electrolytic salt of lithium, in a bridged compound of a polymer of 2-(2-methoxyethoxy)ethyleneglycidylether and a copolymer of 2-(2-methoxyethoxy)ethyleneglycidylether and ethylene oxide.

According to the report, though the ionic conductivity of said high molecular solid electrolytes was $4\times10^{-5}$ S/cm at a temperature of 30° C., its transference number which represents ionic conduction by migration of cations (herein, lithium ion) was about 0.1, showing that most of the ionic conduction was ascribed to the migration of anions. That is, the ionic conduction of the above-described high molecular solid electrolyte was not ascribed to the migration of cations.

In the past, inventors of the present invention already showed that alkalisiloxyaluminate would be usable as a conductive material (at the general meeting of the Japanese Chemical Society in 1994, 21st Ionics Forum, etc.).

However, the technical method for using this material as a solid electrolyte for cells was unsatisfactory due to insufficient means for prevention of migration of anions, low ionic conductivity and lack of flexibility as a material.

Also, Japanese Patent Laid-open Publication No.8-259698(1996) or No.8-301879(1996) disclosed a high molecular electrolyte which contained an aluminum atom in its principal chain with the aim of improving the transference number of cations. However, this material also showed a great difficulty in raising the transference number as well as those disclosed in Chemistry of MATERIALs, 1994, NO.12, Vol.6, p2208.

It is an object of the present invention to provide a conductive material having a large cationic transference number, small amounts of polarization, high flexibility and high ionic conductivity, which would solve the problems in the prior art.

SUMMARY OF THE INVENTION

The conductive material of the present invention comprises high molecular compounds and alkalisiloxyaluminate.

The present invention provides conductive materials having satisfactorily good ionic conductivity, very high transference numbers and sufficient flexibility.

BRIEF DESCRIPTION OF THE DRAWINGS

FIG. 11A is a cross-sectional view.

FIG. 11B is a perspective view illustrating a setting method of a sample.

DETAILED DESCRIPTION OF THE INVENTION

Figure 1:
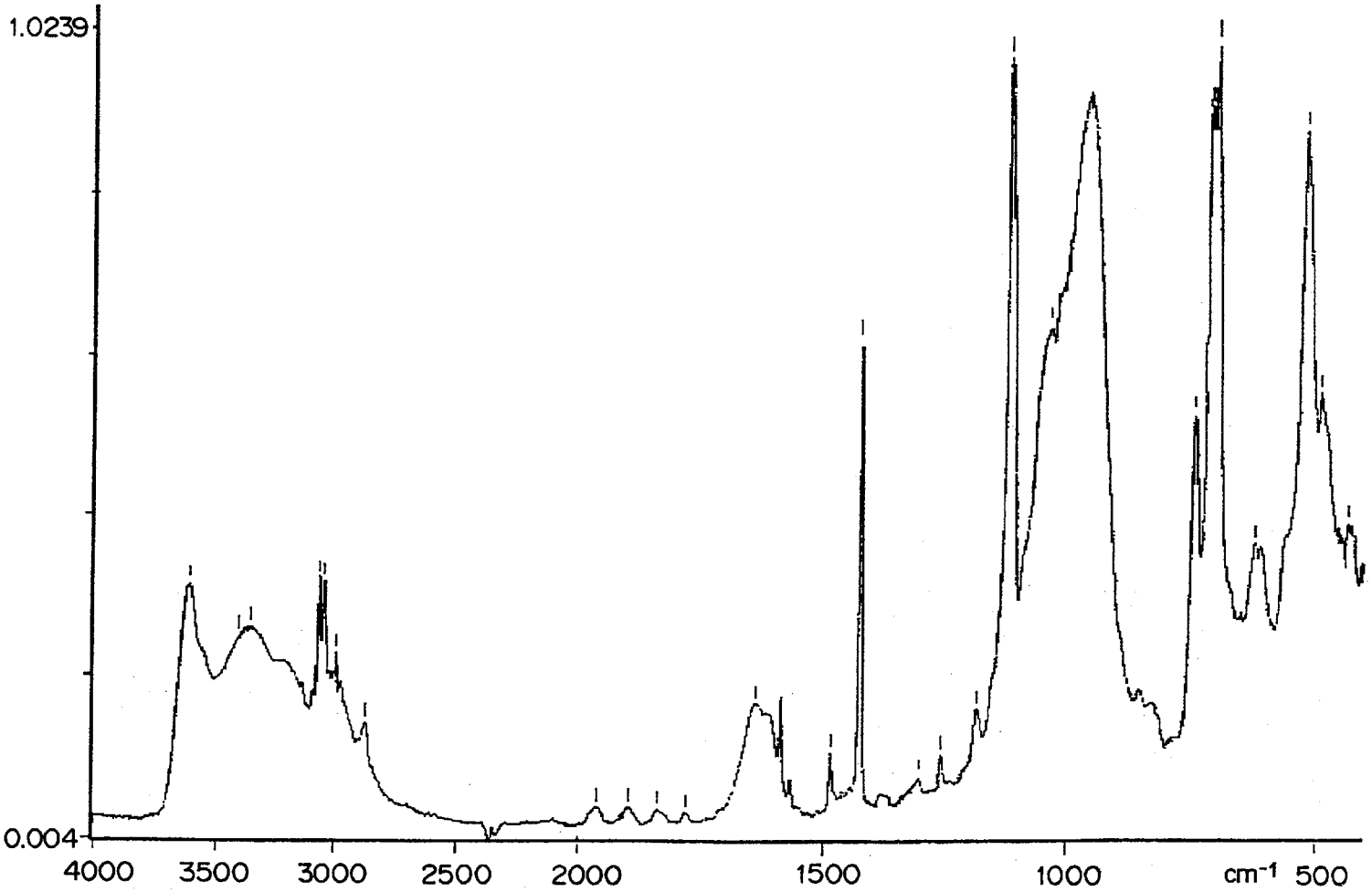
FIG. 1 illustrates infrared absorption spectra of lithiumsiloxyaluminate having two phenyl groups synthesized in Examples.

The conductive material of the present invention is so configured that alkalisiloxyaluminate contained therein can lower a freedom of the ionic migration, as a result, improving the cationic transference number.

The alkali contained in said alkalisiloxyaluminate is an alkaline metal. Lithiumsiloxyaluminate and sodiumsiloxyaluminate are other examples which are similar to the alkalisiloxyaluminate. The said alkalisiloxyaluminate has a structure shown as Chemical Formula 1. In the Chemical Formula 1, "M" represents atoms of alkaline metal.

Moreover, if the alkaline metal contained in said examples is lithium or sodium, it can be used as an electrolyte for a lithium ion cell or for a sodium ion cell respectively.

In addition, a terminal group of said alkalisiloxyaluminate is preferably protected by a phenyl group of aromatic hydrocarbon and the like or by an alkyl group to provide chemical stability. An ethyl, propyl, butyl groups besides a phenyl group can be used as a protecting group which are easily synthesized and available. However, if the said terminal group is protected by a methyl group, there are some difficulties in terms of preservation and stability as a material.

[Chemical Formula 1]

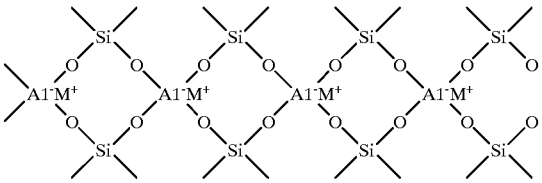

The said alkalisiloxyaluminate can be obtained by reacting dialkylsilanediol with lithium aluminum hydride. Also, a different functional group can be selected, if appropriate, instead of an alkyl group.

Said alkalisiloxyaluminate, when used in conjunction with high molecular compounds, can lower a freedom of the migration, as a result, improving the cationic transference number. The high molecular compound to be used herein is preferably a bridged high-molecular compound. That is, thanks to three dimensional network structures of bridged high-molecular compounds, the degree of the migration of alkalisiloxyaluminate is significantly reduced, resulting in a remarkable improvement of the cationic transference number. Especially, if the molecular weight of alkalisiloxyaluminate is larger (for example, more than 1000), better results can be obtained.

Chemical bond between alkalisiloxyaluminate and said high-molecular compound is preferable because it reduces the migration of anions. Such chemical bond between alkalisiloxyaluminate and said high-molecular compound includes ordinary covalent bonding.

However, the use of organic high-molecular compound having a quaternary amino group allows ionic bonding between nitrogen in an amino group and aluminum in alkalisiloxyaluminate. To produce a quaternary amino group, a method to react a tertiary amino group with methyl halide is available. Moreover, in the process of changing a tertiary amino group to a quaternary amino one, it is not necessary for all tertiary amino groups to become a quaternary amino group. The existence of tertiary amino groups that remain unchanged to quaternary amino groups is acceptable. The increase in numbers of quaternary amino groups causes the high molecular compound to be bound more to alkalisiloxyaluminate, thus leading to increased bridged sites. This means that flexibility of a conductive material can be adjusted by increasing or decreasing the numbers of quaternary amino groups therein. The preferred methyl halide to be used is methyl iodide which is highly reactive liquid at a normal temperature and can be handled easily.

Such organic high-molecular compounds having quaternary amino groups include a copolymer (also referred to herein as "MMA-TMAEMA") of methylmethacrylate-.methacrylate 2-(trimethylamino)ethyliodide (referred to as "methylmethacrylate unit or MMA") and methacrylate 2-(trimethylamino)ethyliodide unit (referred to as "TMAEMA"). A copolymer obtained by using, instead of methylmethacrylate, vinyl monomers such as ethylmethacrylate, butylmethacrylate, methylacrylate, styrene, etc. is also usable.

Furthermore, a quaternary copolymer of said vinyl monomers and methacrylate 2-(trimethlylamino)vinylpyridine can be used as well.

MMA-TMAEMA can be obtained by copolymerization, in the presence of a catalyst, of methylmethacrylate and methacrylate 2-(dimethylamino) ethyl followed by a reaction with methyliodide.

An organic high-molecular compound, the concept of which is shown as Chemical Formula 2 where "Me" and "Ph" represent a methyl group and a phenyl group respectively, obtained by chemically (i.e., by an ionic bond) binding said MMA-TMAEMA to alkalisiloxyaluminate can be used as an excellent conductive material which satisfies all conditions including the transference number, ionic conductivity and flexibility.

[Chemical Formula 2]

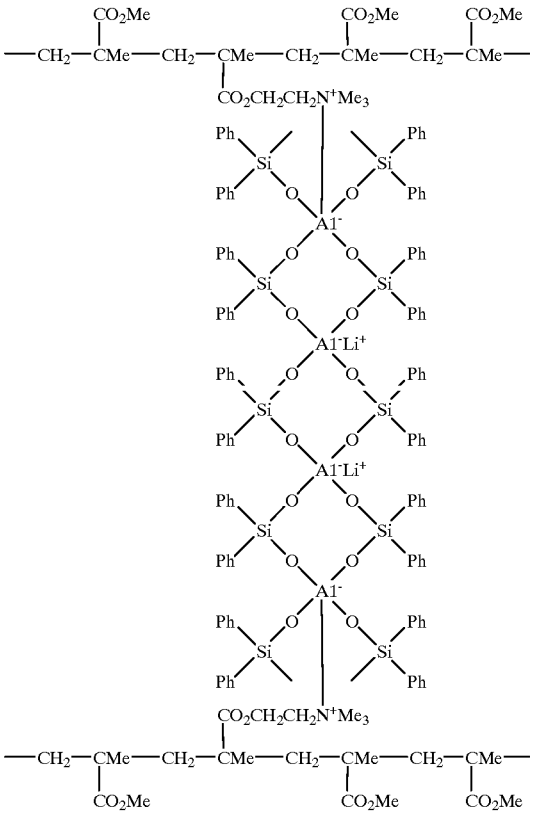

Another example of an organic high-molecular compound having a quaternary amino group is a copolymer of N,N-dialkylalkenylamide and methacrylate 2-trimethylaminoethyl iodide. This includes N,N-dimethylacrylamide.methacrylate 2-trimethylaminoethyl iodide copolymer which can be obtained by copolymerization of N,N-dimethylacrylamide and methacrylate 2-dimethylaminoethyl followed by a reaction with methyl iodide (see Chemical Formula 3). N,N-dimethylacrylamide having quaternary nitrogen is also used.

[Chemical Formula 3]

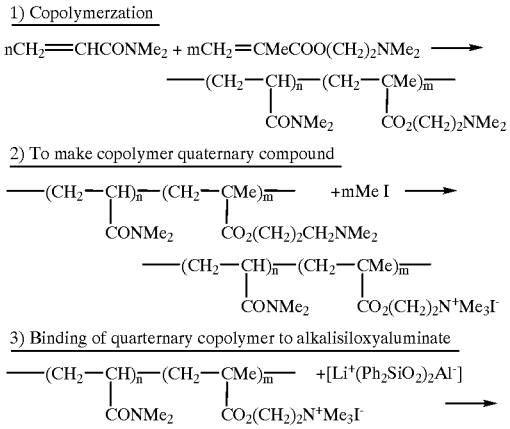

-continued

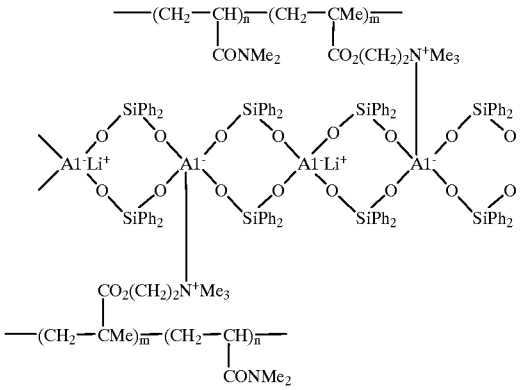

Further, another example is a copolymer of isopropylalkenylamide polymer and methacrylate 2-trimethylamino ethyl iodide. This includes N-isopropylacrylamide.methacrylate 2-trimethylaminoethyl iodide copolymer which can be obtained by copolymerization of N-isopropylacrylamide and methacrylate 2-dimethylamino ethyl followed by a reaction with methyl iodide. N-isopropylacrylamide having quaternary nitrogen is also used.

In the case of using the N-isopropylacrylamide.methacrylate 2-trimethylaminoethyl iodide copolymer, immobilizing reaction of alkalisiloxyaluminate can be completed at a lower temperature and in a shorter time when compared with the case of using MMA-TMAEMA. In addition, a higher transference number is maintained and higher ionic conductivity is achieved. This is possibly because amides contained in N-isopropylacrylamide have a strong affinity for a polar organic solvent and therefore electrolytes are easily incorporated into gels.

[Chemical Formula 4]

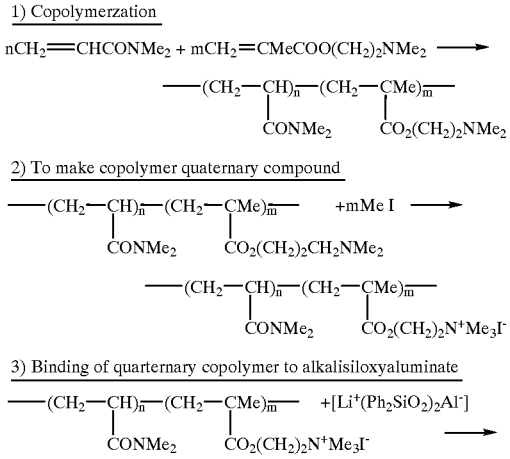

-continued

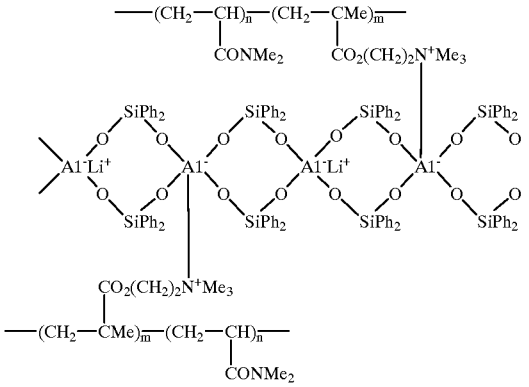

Moreover, the mixing ratio of alkalisiloxyaluminate to the high molecular compound having the said quaternary amino group is preferably more than 0.05 and less than 20. If this ratio of said alkalisiloxyaluminate is less than 0.05, the ionic conductivity is lowered and if it is more than 20, the flexibility is reduced, thereby making impossible to obtain required flexibility for conductive materials.

In a high-molecular compound comprising a monomer unit having no quaternary amino groups such as a methylmethacrylate.methacrylate 2-(trimethylamino)ethyl iodide copolymer and a vinyl monomer unit having quaternary amino groups, the mole ratio (also referred to herein as "copolymerization ratio") which is a molar ratio of a vinyl monomer unit having no quaternary amino groups such as a methyl methacrylate unit to a vinyl monomer having quaternary amino groups such as methacrylate 2-(trimethylamino)ethyl iodide is preferably more than 5 and less than 50. If the mole ratio is less than 5, too many bridge bonds by alkalisiloxyaluminate occur in the high molecular compound having quaternary amino groups, causing too solid compounds. On the other hand, it is more than 50, too little bridge bonds are formed, causing no formation of gels when plasticizer is used.

EXAMPLES

Examples of the present invention are described below. Methacrylate polymers have been used as substances to be chemically bound to alkalisiloxyaluminate in the Examples 1 and 2, N,N-dialkylalkenylamide polymers in the Example 3 and N-isopropylalkenylamide in the Example 4 respectively.

Example 1

Example of the Use of Methacrylate Polymers as Substances to be Chemically Bound to Alkalisiloxyaluminate

Use of MMA-TMAEMA

Synthesis of Lithiumsiloxyaluminate (See Chemical Formula 5)

Lithiumsiloxyaluminate having a phenyl substituent as alkalisiloxyaluminate was selected and following synthesis was performed.

[Chemical Formula 5]

$2Ph_2Si(OH)_2 + LiAlH_4 \longrightarrow$

-continued

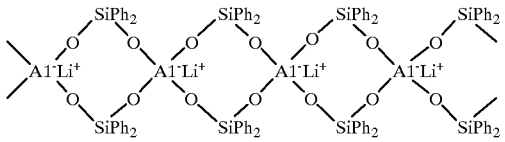

That is, 8.66 g (40.03 mmol) of dried diphenylsilanediol and 75 ml of tetrahydrofuran were placed, in an atmosphere of argon, in a 300 ml three-neck flask and the resulting solution was cooled to a temperature of −78° C. To the solution, 1 mol/l of solution of lithiumaluminiumhydride-.tetrahydrofuran was added dropwise, to make 20.01 mmol of lithiumaluminiumhydride and, reacted with stirring for 2 hours while its temperature was returned to a room temperature. No precipitates and deposits were found in the resulting solution after the reaction. Following above the reaction, vacuum drying was carried out. The weight of the resulting reactant was 12.655 g and its yield was 137%, which was due to incomplete removal of the solvent tetrahydrofuran.

The infrared absorption spectrum of the reactant was shown in FIG. 1 and its $^{1}$H-NMR, $^{13}$C-NMR, $^{27}$Al-NMR and $^{29}$Si-NMR spectra in FIG. 2, FIG. 3, FIG. 4 and FIG. 5.

Figure 2:
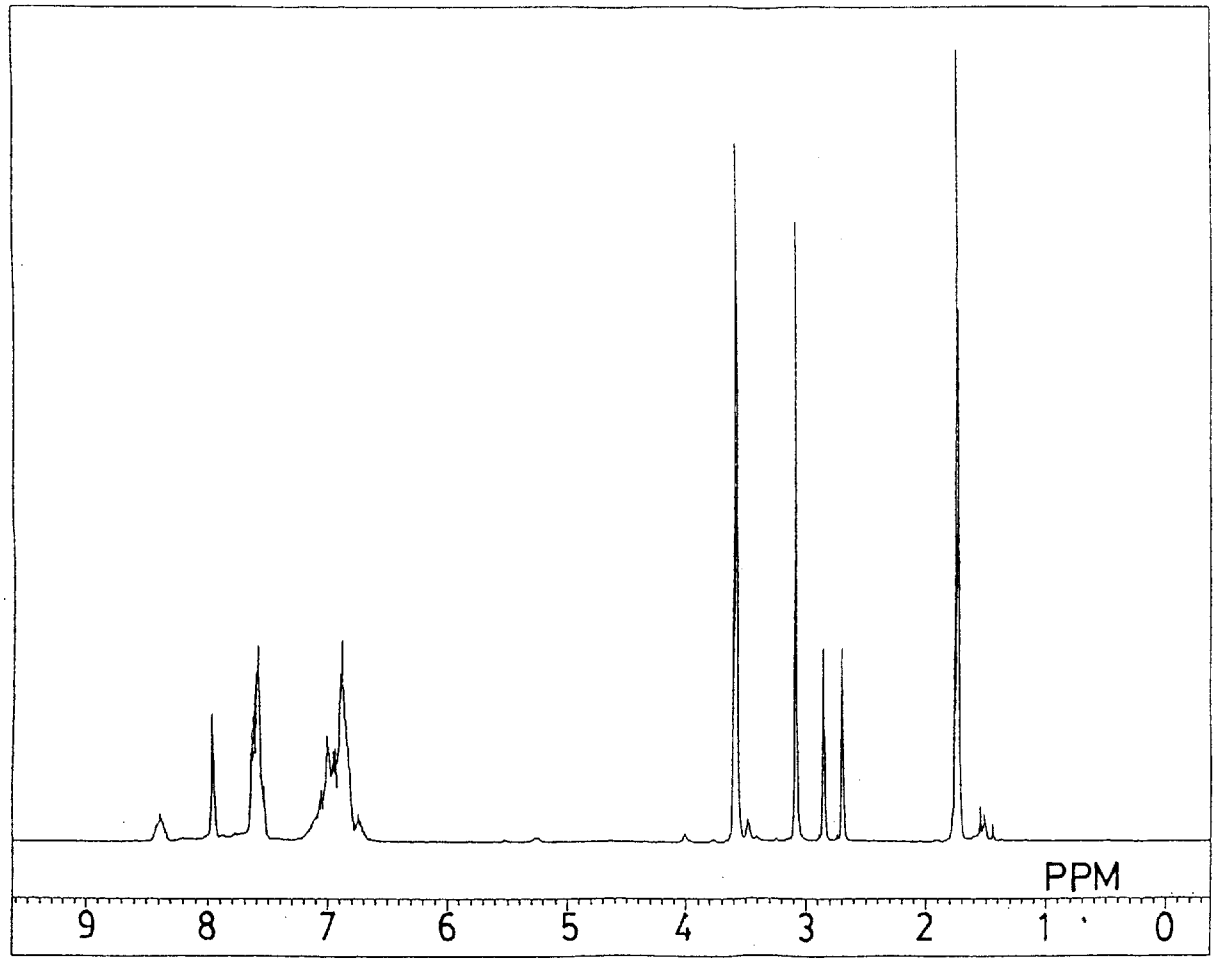
FIG. 2 illustrates $^{1}$H-NMR spectra of lithiumsiloxyaluminate having two phenyl groups synthesized in the Examples.
Figure 3:
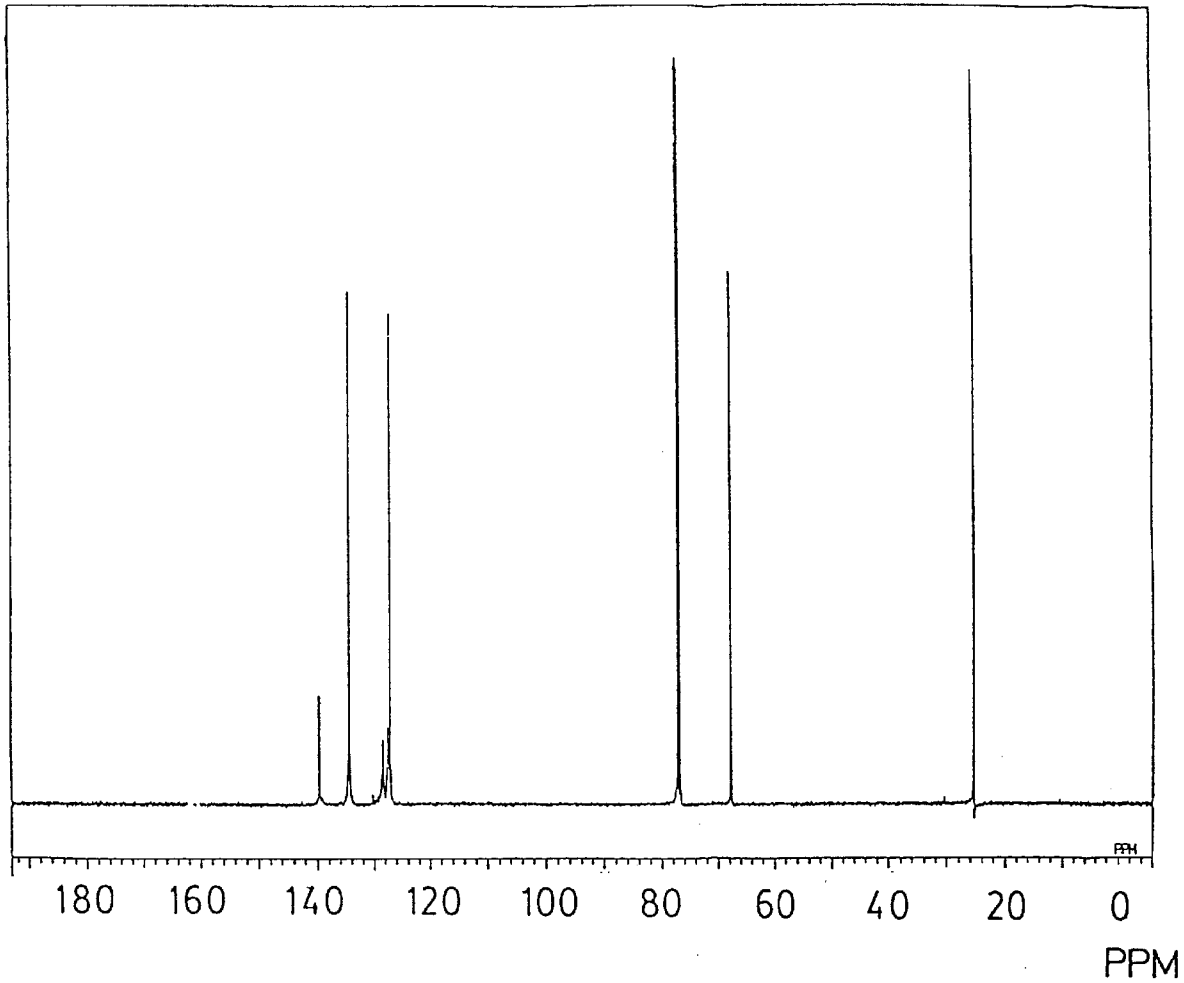
FIG. 3 illustrates $^{13}$C-NMR spectra of lithiumsiloxyaluminate having two phenyl groups synthesized in the Examples.
Figure 4:
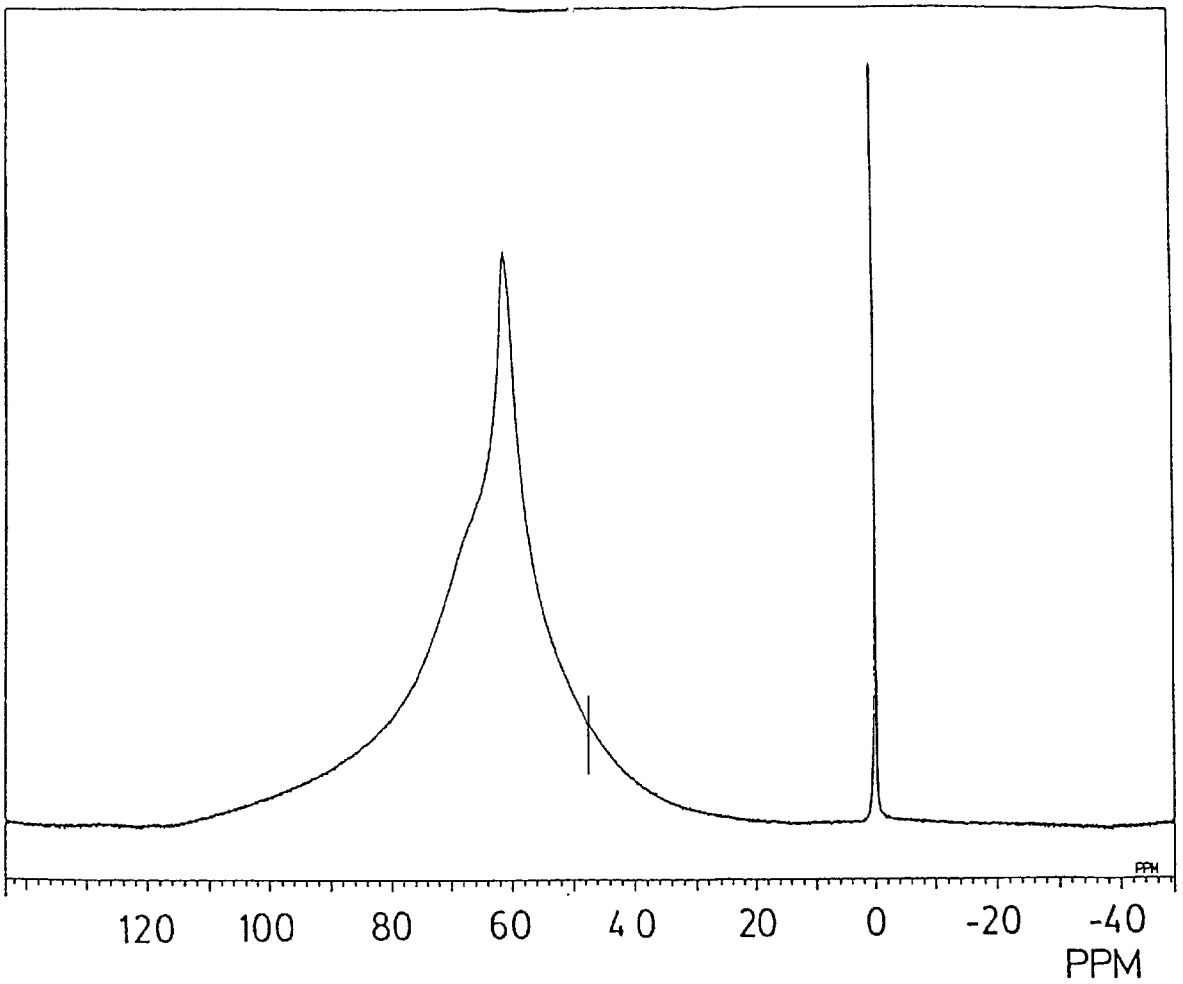
FIG. 4 illustrates $^{27}$Al-NMR spectra of lithiumsiloxyaluminate having two phenyl groups synthesized in the Examples.
Figure 5:
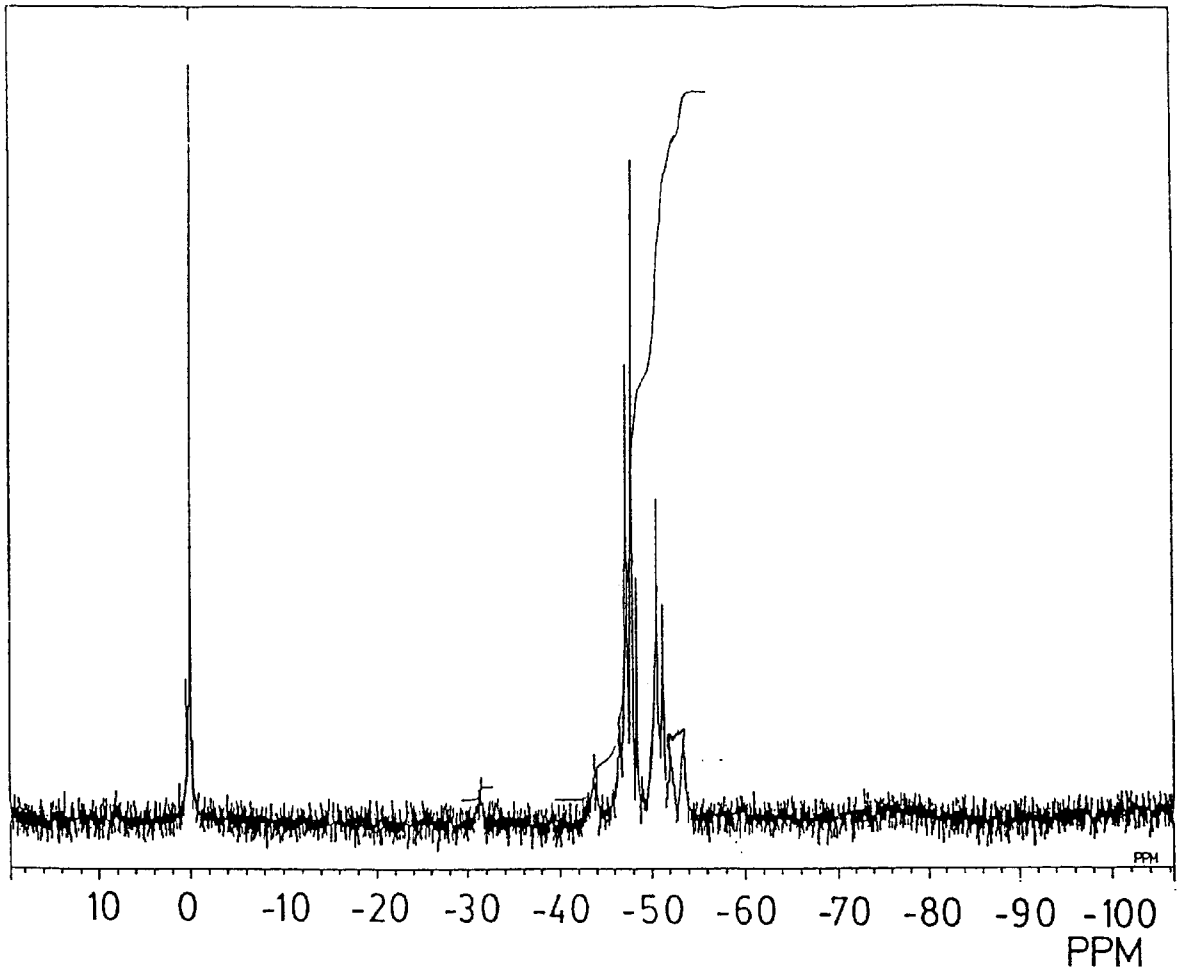
FIG. 5 illustrates $^{29}$Si-NMR spectra of lithiumsiloxyaluminate having two phenyl groups synthesized in the Example.

FIG. 2 shows results of measurements using deuterated $C_3D_7NO$ (referred to as DMF-$d_7$) of dimethylformamide as solvent. The symbol ppm in Figures represents a value of amount of tetramethylsilane (TMS) used as internal standard solution. FIG. 3 shows results of measurements using $CDCl_3$ as solvent, and FIG. 4 and FIG. 5 show results of measurements using $CD_3OD$ as solvent.

As shown in FIG. 1, the substance exhibits absorptions due to an aromatic compound at the wave numbers of about 1420 cm$^{-1}$ and 1120 cm$^{-1}$, absorptions due to Si—O bonding at 900–1100 cm$^{-1}$, absorptions due to a substituent aromatic compound at about 700 cm$^{-1}$, and absorptions due to a compound $Si(C_6H_5)_2$ at about 520 cm$^{-1}$.

Moreover, as shown in FIG. 2, a peak due to proton with aromatic rings centers at about 6.8–7.6 ppm. As shown in FIG. 4 as $^{27}$Al-NMR spectra, a peak due to four coordinated tetrahedral structure of aluminum element about 60–70 ppm, and as FIG. 5 as $^{29}$Si-NMR spectra, both peaks due to four coordinated tetrahedral structure of $(C6H5)_2SiO_2Al$ about −47 ppm and −50 ppm. Other peaks in FIGS. 2, 4 and 5 were due to impurities.

In addition, an ICP (inductively coupled plasma) analysis and CHNS/O elemental analysis were performed. Table 1 shows results including both measured and theoretical values.

TABLE 1

| | Al | Li | Si | C | H | O |
|---|---|---|---|---|---|---|
| Measured value (%) | 6.0 | 1.5 | 11.7 | 61.0 | 4.4 | 15.4 |
| Theoretical value (%) | 5.9 | 1.5 | 12.2 | 62.3 | 4.3 | 13.8 |

On the other hand, the determination of the molecular weight of the substance by GPC (gel permeation chromatography: using the equipment HLC802A from TOSOH Corp.) revealed dual-peaked molecular weight distribution having peaks at molecular weight of about 5800 and 2300.

Synthesis of methylmethacrylate.methacrylate 2-(dimethylamino)ethyl Copolymer (See Chemical Formula 6)

Methlymethacrylate.methacrylate 2-(trimethylamino) ethyl iodide copolymer (MMA-TMAEMA) as an organic high molecular compound having an amino group was selected and following synthesis was performed.

Firstly, 18.66 g (186.4 mmol) of methylmethacrylate from which a polymerization inhibitor was removed by vacuum distillation, 1.465 g (9.32 mmol) of methacrylate 2-(dimethylamino)ethyl with a polymerization inhibitor removed in the same way as above, 0.15 g of α,α'-azobis (isobutyronitrile) (referred to as "AIBN") and 50 ml of tetrahydrofuran were placed into a 100 ml flask. After the solution was cooled with liquid nitrogen and frozen, a pressure reducing process was repeatedly carried out on it to remove oxygen from monomers and tetrahydrofuran. After six hours heating while the solvent was refluxed, the resulting substance was dropped into methanol and a polymer lying as a layer at the bottom was taken out by decantation. The separated polymer was washed with methanol several times and dissolved in tetrahydrofuran and the same washing process was repeated.

After vacuum drying, a milk white solid methylmethacrylate.methacrylate 2-(dimethylamino) copolymer was obtained (obtained amount: 13.64 g, yield: 67.8%).

Figure 6:
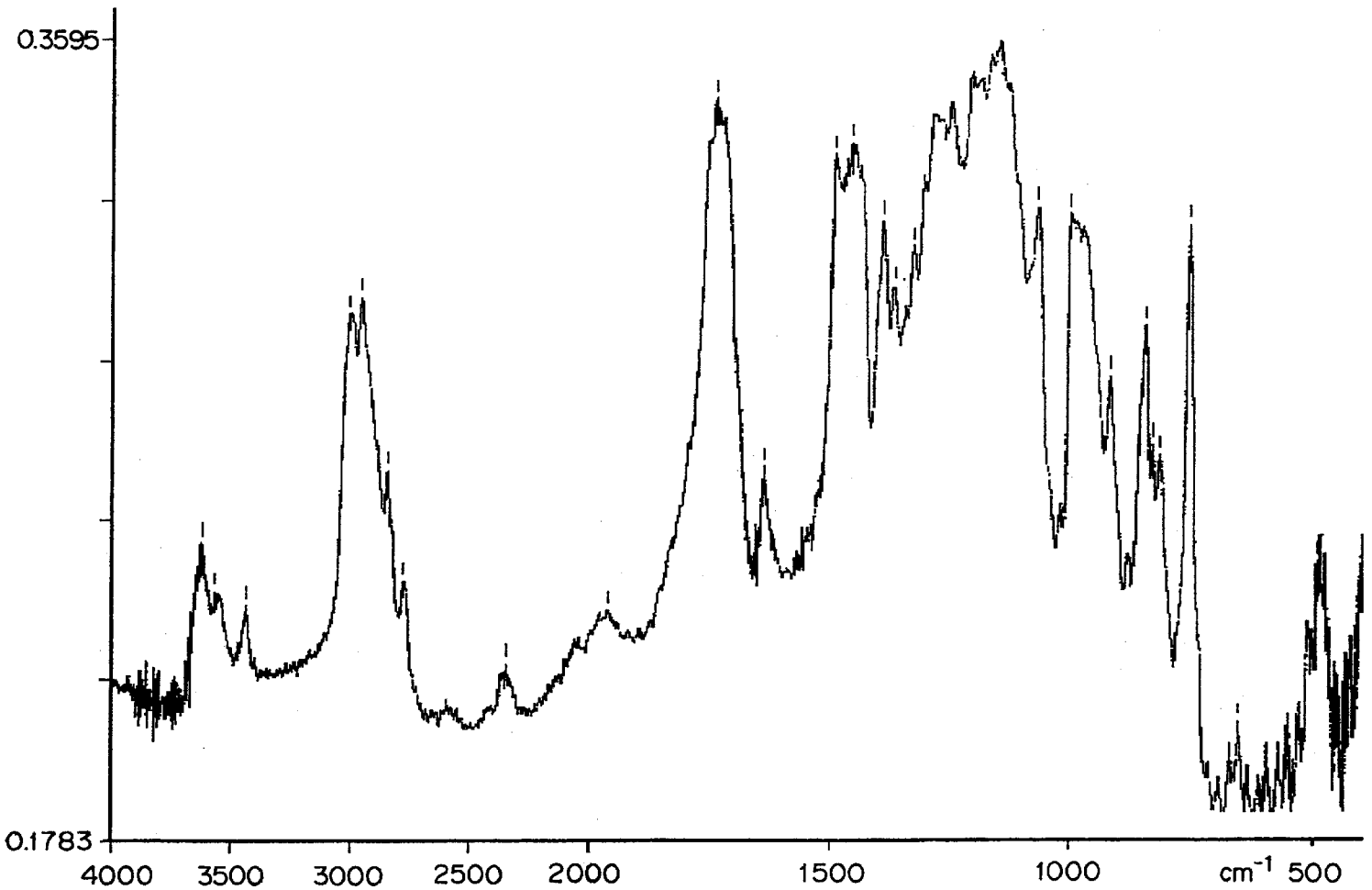
FIG. 6 illustrates infrared absorption spectra of methyl methacrylate.methacrylate 2-(dimethylamino)copolymer synthesized in the Example.

The infrared absorption spectra of the substance was shown in FIG. 6 and its $^1$H-NMR spectra (solvent: DMF-$d_7$) in FIG. 7. As shown in FIG. 6, the substance exhibits absorptions due to C═O bonding at the wave numbers of about 1700 $cm^{-1}$, absorptions due to —O— bonding at 1000–1300 $cm^{-1}$, absorptions due to amines at about 3400 $cm^{-1}$, however, it did not exhibit strong absorptions due to alkenes at about 900 $cm^{-1}$.

Figure 7:
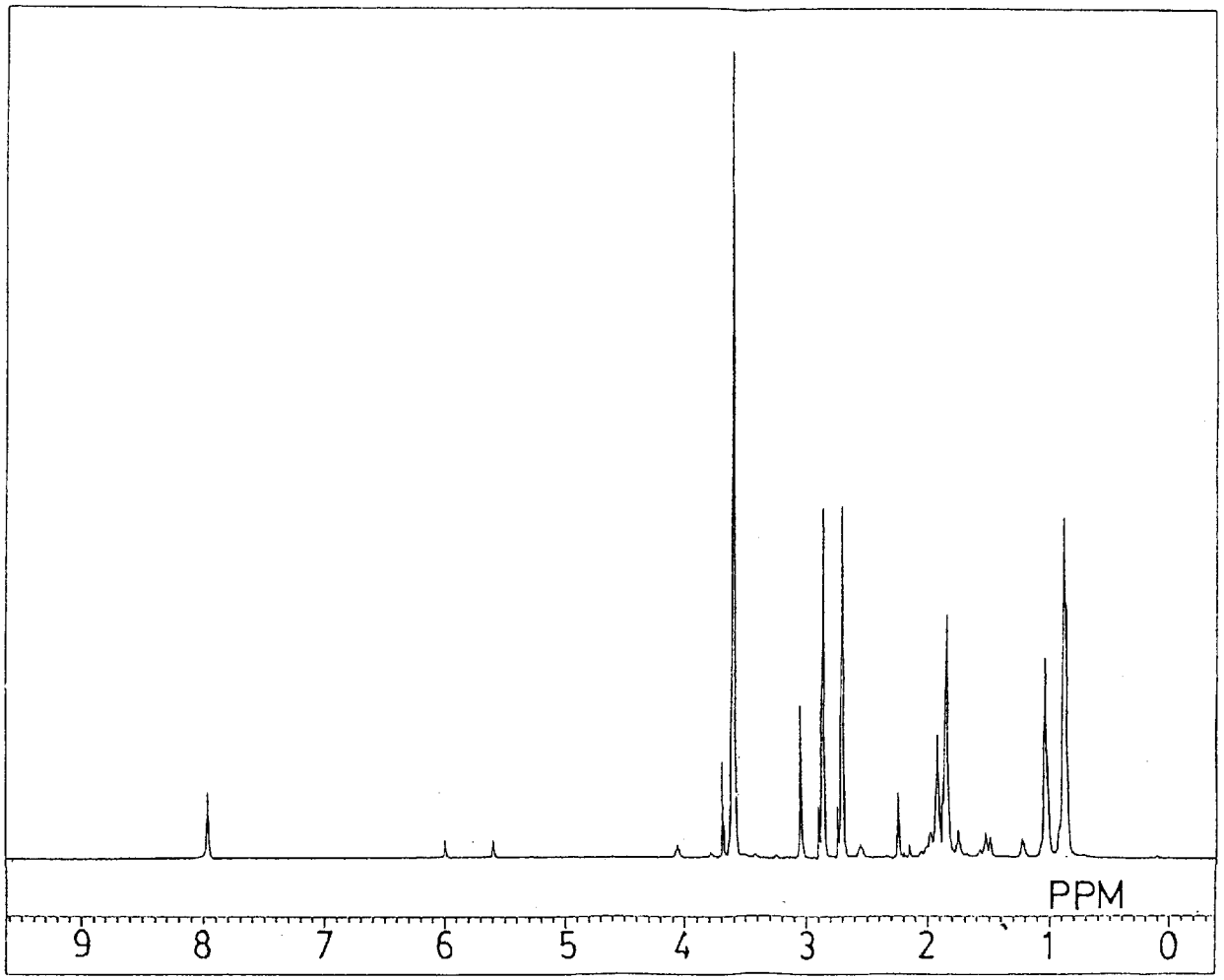
FIG. 7 illustrates $^{1}$H-NMR spectra of methyl methacrylate.methacrylate 2-(dimethylamino)ethyl copolymer.

In FIG. 7 showing $^1$H-NMR spectra (DMF-$d_7$), are seen a peak due to $CH_3$—O bonding centers at about 3.6 ppm, peak due to $CH_3$—N bonding at 2.3 ppm, peak due to $CH_3$—C bonding at 0.8–1.1 ppm, peak due to —CH—C bonding at 2.0 ppm, peak due to —$CH_2$—N bonding at 2.5–2.6 ppm and peak due to —$CH_2$—O bonding at 4.1 ppm. Other peaks were due to impurities.

A CHNS/O elemental analysis was performed. Table 2 shows results including both measured and theoretical values. The calculation based on these values showed that a present mole ratio of methylmethacrylate unit to methacrylate 2-(dimethylamino)ethyl unit was 18.6:1 (20:1 at the time of preparation). The measurement using GPC equipment HLC802A (TOSOH Corp.) showed that molecular weight was 270000.

TABLE 2

| | C | H | N | O |
|---|---|---|---|---|
| Measured value (%) | 60.09 | 8.13 | 0.69 | 31.09 |
| Theoretical value (%) | 60.05 | 8.08 | 0.62 | 31.25 |

Another synthesis was performed in the same method as above using 19.50 g (194.8 mmol) of methylmethacrylate, 2.20 g (14.0 mmol) of methacrylate 2-(dimethylamino)ethyl, 0.14 g of α,α'-azobis(isobutyronitrile) and 50 ml of tetrahydrofuran and, as a result, a copolymer having the mole ratio of methylmethacrylate unit to methacrylate 2-(dimethylamino)ethyl unit of 12.3 was obtained. The obtained amount was 12.66 g (yield being 58.3%).

Figure 8:
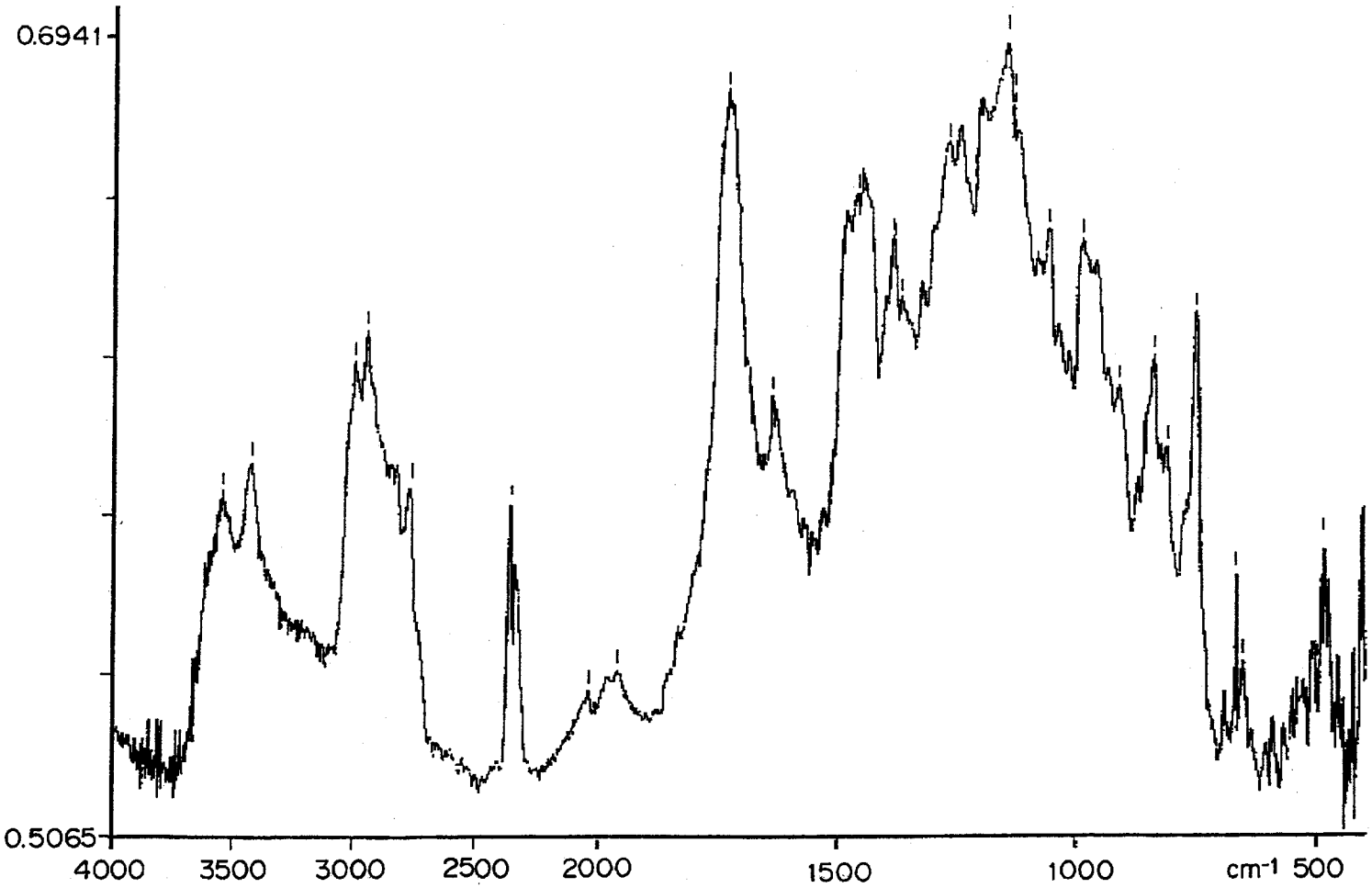
FIG. 8 illustrates infrared absorption spectra of methyl methacrylate.methacrylate 2-(dimethylamino)copolymer synthesized in the Example.

Also, another synthesis was performed in the same method as above using 19.90 g (198.8 mmol) of methylmethacrylate, 3.81 g (24.2 mmol) of methacrylate 2-(dimethylamino)ethyl, 0.14 g of α,α'-azobis (isobutyronitrile) and 50 ml of tetrahydrofuran and, as a result, a copolymer having the mole ratio of methylmethacrylate unit to methacrylate 2-(dimethylamino)ethyl unit of 7.8 was obtained. The obtained amount was 15.44 g (yield being 65.1%). FIG. 8 shows an IR spectra of the copolymer. The measurement using GPC equipment HLC802A (TOSOH Corp.) showed that average molecular weight was 210000.

Synthesis of MMA-TEAEMA (See Chemical Formula 6)

11.98 g of a methylmethacrylate—methacrylate 2-(dimethylamino)ethyl copolymer having a mole ratio of said methylmethacrylate unit to methacrylate 2-(dimethylamino)ethyl unit of 18.6 (20:1 at the time of preparation) was placed into a 200 ml flask and 80 ml of acetone was added thereto. To this solution, 1.69 g (11.9 mmol) of methyl iodide was added slowly and stirring was performed for 2 hours at a room temperature (the solution became yellow). The solution was added dropwise to hexane and the substance lying as a layer at the bottom was taken out by decantation.

After being washed with hexane, the polymer was again dissolved in acetone and the same washing process with hexane was repeated. Then vacuum drying was performed to obtain yellow solid MMA-TMAEMA (copolymerization ratio being 18.6:1). The obtained amount was 10.42 g and its yield was 81.3%.

[Chemical Formula 6]

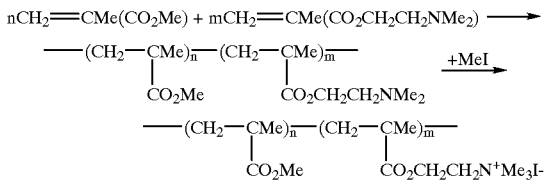

Moreover, 11.53 g of methylmethacrylate—methacrylate 2-(dimethylamino)ethyl copolymer having a mole ratio of said methylmethacrylate unit to methacrylate 2-(dimethylamino)ethyl unit of 12.3 (15 at the time of preparation) was dissolved in 70 ml of acetone. To this solution, 3.50 g (24.7 mmol) of methyl iodide was added. Then, the same procedures as above were taken to obtain yellow solid MMA-TMAEMA (copolymerization ratio being 12.3:1). The obtained amount was 9.99 g and its yield was 78.7%.

Furthermore, 5.68 g of methylmethacrylate—methacrylate 2-(dimethylamino)ethyl copolymer having a mole ratio of said methylmethacrylate unit to methacrylate 2-(dimethylamino)ethyl unit of 7.8 (10 at the time of preparation) was dissolved in 40 ml of acetone. To this solution,2.58 g (18.2 mmol) of methyl iodide was added. Then, the same procedures as above were taken to obtain yellow solid MMA-TMAEMA (copolymerization ratio being 7.8:1). The obtained amount was 5.19 g and its yield was 85.7%.

Immobilization of lithiumsiloxyaluminate

Said lithiumsiloxyaluminate was chemically bound to MMA-TMAEMA and their organic solvent gels were formed. All these processes were performed in an atmosphere of argon.

Firstly, 2.81 g of lithiumsiloxyaluminate was placed into a 300 ml three-neck flask and 10 ml of dimethylformamide was added thereto and dissolved at a temperature of 35° C.

Meanwhile, 3.07 g of MMA-TMAEMA (copolymerization ratio being 18.6:1) was placed into a 100 ml flask and 15 ml of dimethylformamide was added and then dissolved at a temperature of 50° C. This solution was slowly poured into the lithiumsiloxyaluminate-dimethylformamide solution using a Teflon tube. The mole ratio of aluminum contained in lithiumsiloxyaluminate (at the time of preparation) to a quaternary amino group contained in MMA-TMAEMA was 4:1.

After said mixture was stirred at a temperature of 35° C. for 2 hours, ion-bridged polymer was deposited by adding 100 ml of acetone. The polymer lying as a layer at the bottom was taken out by decantation and, after being washed with acetone several times, dissolved again in 10 ml of dimethylformamide. To this solution, 100 ml of acetone was added, then followed by decantation and the. repetition of washing with acetone. A white polymer α was obtained by performing vacuum drying on the taken-out polymer. The obtained amount was 1.28 g and its yield was 22.5%.

Figure 9:
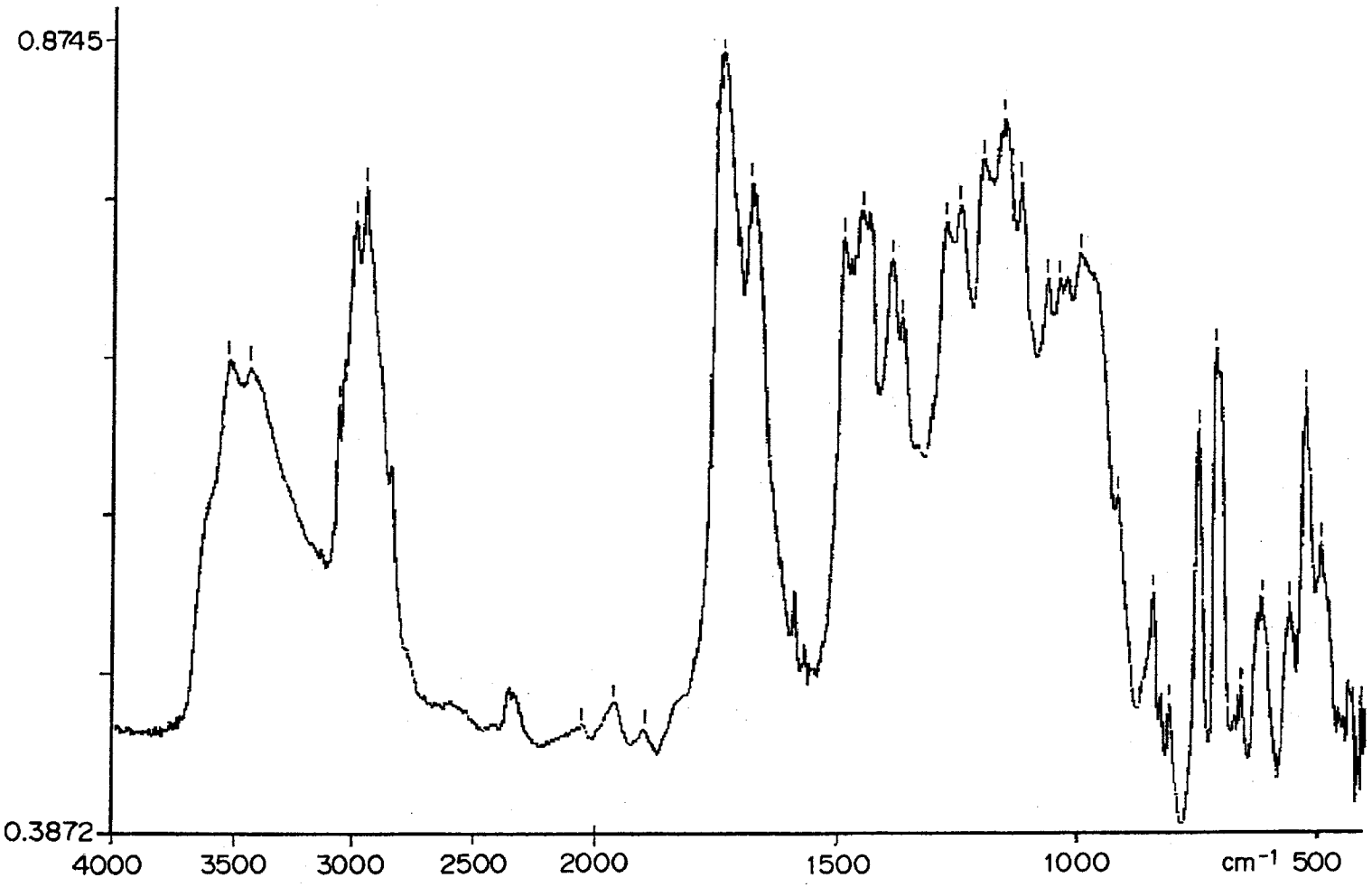
FIG. 9 illustrates infrared absorption spectra of methyl methacrylate.methacrylate 2-(trimethylamino)ethyl iodide copolymer chemically bound to lithiumsiloxyaluminate.
Figure 10:
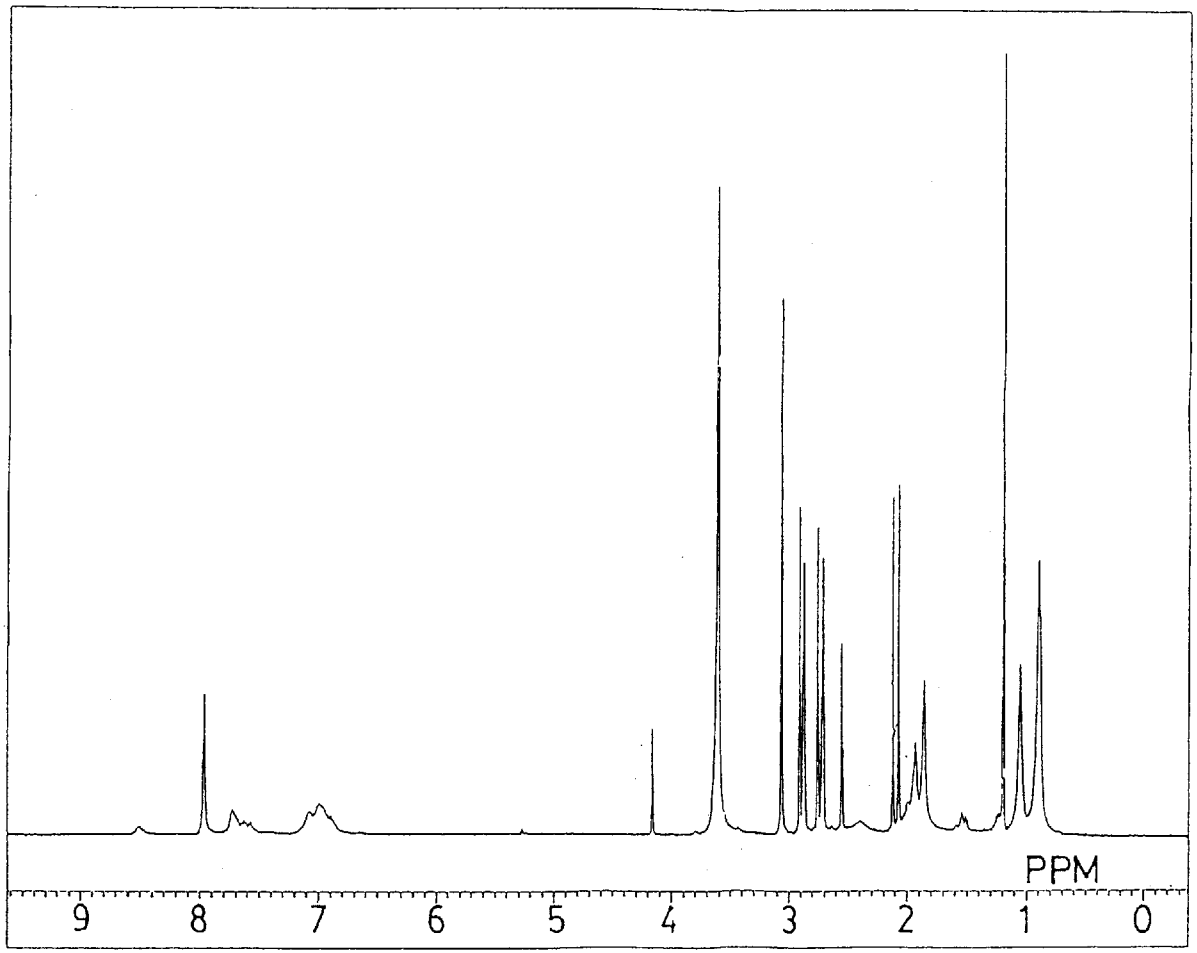
FIG. 10 illustrates $^{1}$H-NMR spectra of methyl methacrylate.methacrylate 2-(trimethylamino)ethyl iodide copolymer chemically bound to lithiumsiloxyaluminate.

FIG. 9 shows the IR spectra of the obtained polymer by FT-IR and FIG. 10 shows its $^1$H-NMR spectra (solvent:DMF-$d_7$).

As shown in FIG. 9, the polymer exhibits absorptions due to C═O bonding at the wave numbers of about 1700 $cm^{-1}$, absorptions due to —O— bonding at 1000–1300 $cm^{-1}$, absorptions due to amines at about 3400 $cm^{-1}$, absorptions due to aromatic compounds at about 1420 $cm^{-1}$ and 1120 $cm^{-1}$, absorptions due to Si—O at 900–1100 $cm^{-1}$, absorptions due to substituent aromatic compounds at about 700 $cm^{-1}$ and absorptions due to $Si(C_6H_5)_2$ at about 520 $cm^{-1}$.

In FIG. 10, a peak due to $CH_3$—N bonding centers at 2.2–2.3 ppm, peak due to $CH_3$—C bonding at 0.8–1.1 ppm, peak due to $CH_2$—C bonding at 1.8–2.0, peak due to —$CH_2$—N bonding at 2.5–2.6 ppm, peak due to —$CH_2$—C bonding at 4.0–4.2 ppm and peak due to $(C_6H_5)$— structure at 6.8–7.2 ppm. Other peaks were due to impurities.

In addition, an ICP (inductively coupled plasma) analysis and CHNS/O elemental analysis were performed. Table 3 shows results including both measured and theoretical values. The calculation based on these values showed that an existing mole ratio of methylmethacrylate unit to methacrylate 2-(trimethylamino)ethyl unit and to lithiumsiloxyaluminate unit was 18.6:1:3.5. The measurement using GPC equipment HLC802A (TOSOH Corp.) showed that its molecular weight was 290000.

TABLE 3

| | Al | Li | Si | C | H | N | O |
|---|---|---|---|---|---|---|---|
| Measured value (%) | 2.61 | 0.66 | 5.42 | 61.07 | 6.44 | 0.39 | 23.41 |
| Theoretical value (%) | 2.79 | 0.73 | 5.82 | 61.15 | 6.31 | 0.36 | 22.84 |

Also, 1.11 g of lithiumsiloxyaluminate and 0.92 g of MMA-TMAEMA (polymerization ratio: 12.3:1) were dissolved, respectively, in 5 ml and 10 ml of dimethylformamide. Then, the same procedures as above were taken to obtain a polymer β. The mole ratio of aluminum contained in lithiumsiloxyaluminate to a quaternary amino group contained in MMA-TMAEMA (at the time of preparation) was 4:1. The obtained amount was 0.84 g and its yield was 43.1%. An actual analysis showed that an existing mole ratio of methylmethacrylate unit to methacrylate 2-(trimethylamino)ethyl unit and to lithiumsiloxyaluminate unit was 12.3:1:3.8.

Similarly, 1.78 g of lithiumsiloxyaluminate and 1.04 g of MMA-TMAEMA (polymerization ratio: 7.8:1) were dissolved, respectively, in 10 ml and 13 ml of dimethylformamide. Then, the same procedures as above were taken to obtain a polymer γ. The mole ratio of aluminum contained in lithiumsiloxyaluminate to a quaternary amino group contained in MMA-TMAEMA (at the time of preparation) was 4:1. The obtained amount was 0.335 g and its yield was 12.4%. An actual analysis showed that a existing mole ratio of methylmethacrylate unit to methacrylate 2-(trimethylamino)ethyl unit and to lithiumsiloxyaluminate unit was 7.8:1:3.2.

Preparation of Gels

Said three polymers are excellent conductive materials having a large transference number, however, its ionic conductivity is somewhat low. Therefore, gels comprising these polymers and solvent were prepared, which showed a rise in its ionic conductivity.

A dimethylformamide gel of said polymer α, propylenecarbonate gel of said polymer α, and N-methylpyrolidone gel of said polymers α, β and γ were formed in an atmosphere of argon.

0.25 g of powdered polymer α was placed and 0.64 g of dimethylformamide was added thereto. After the mixture was shaken by ultrasonic waves (also referred to as "ultrasonic shaking") for 20 minutes and heated up to 50° C. to obtain a uniform gel A. On the other hand, a uniform gel B was formed by using 0.17 g of said polymer α and 0.39 g of propylenecarbonate in the same manner as above.

Similarly, gels C, D and E were formed by using 0.96 g of said polymer α and 2.24 g of N-methylpyrolidone, 0.35 g of said polymer β and 0.82 g of N-methylpyrolidone, and 0.21 g of said polymer γ and 0.50 g of N-methylpyrolidone respectively. Moreover, these gels B–E are so formed that the ratio by weight between each polymer and plasticizer is about 3:7.

Evaluation of Gels

Each of said gels A–E was cut out so as to make a sheet-shaped sample of 0.39 mm in thickness and 7.9 mm in diameter and the ionic conductivity of each sample in the direction of thickness was measured by an AC impedance measurement method. That is, bulk resistance of electrolyte Rb (Ω) of each sample was determined by Cole-Cole's plotting. Then, based on this bulk resistance Rb, thickness d of a film (cm) and area S of the film ($cm^2$), the ionic conductivity σ (S $cm^{-1}$) of each sample was calculated by Formula 1.

$$\sigma=d/(RbS) \qquad \text{Formula 1}$$

Figure 11A:
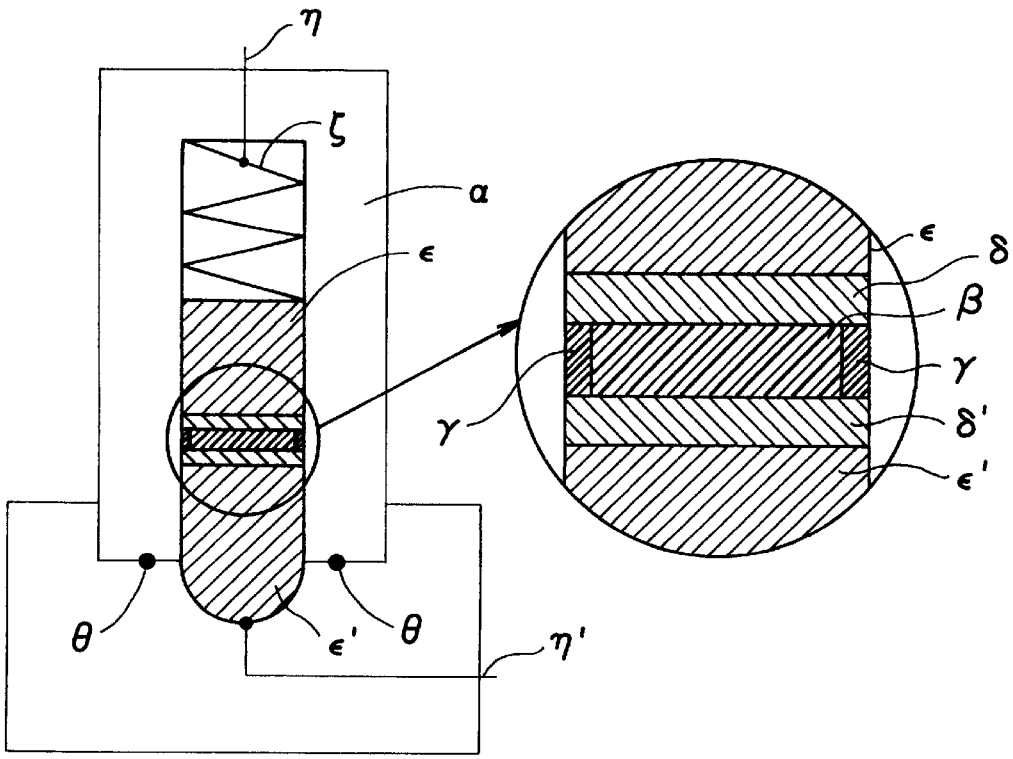
FIGS. 11A and 11B are cross-sectional views of an impedance measurement cell used to determine a transference number.
Figure 11B:
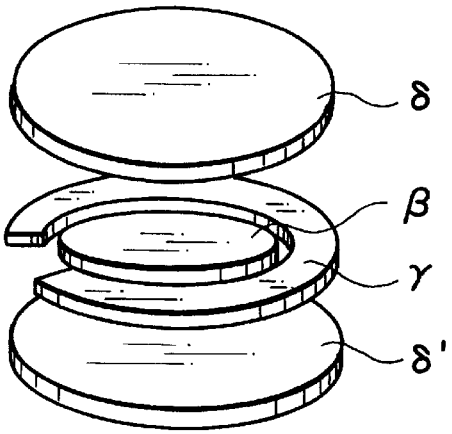

On the other hand, a transference $t_+$ was measured on the basis of reports by PETER G. BRUCE and COLIN A. VINCENT (J. Electroanal. Chem., 255 (1987) p1–17).In this measurement, a cell for measuring impedance, which is shown as "α" in FIG. 11 is employed. A sheet-shaped sample β of 0.5 mm in thickness and 10 mm in diameter was put, together with a spacer γ, between two pieces of lithium metal foils (jigs) δ and δ' (see FIG. 11[*b*]). These lithium metal foils δ and δ' are connected through a stainless steel current collector ϵ and springs ζ and ζ' to terminals η and η'. This cell α is separated to two portions and the separated site is kept hermetic by an O-ring θ.

In order to calculate the transference number,

1) After setting a sample to said measurement cell and leaving for one day, impedance $R_b^O$ and interface impedance $R_{ct}^O$ were measured,
2) Then, a voltage of 10 mV was applied to both poles of the cell for AC impedance and changes in currents with time was traced to ensure that the current was stabilized at constant current $I^s$, and
3) Again, AC impedance was measured to obtain interface impedance $R_{ct}^s$. Based on values obtained by above procedures, the transference number was calculated by Formula 2.

$$t_+=I^s(\Delta V-I^O R_{ct}^O)/I^O/(\Delta V-I^s R_{ct}^s) \qquad \text{Formula 2}$$

where, ΔV=10 mV or $I^O=\Delta V/(R_b^O+R_{ct}^O)$.

The results obtained from above calculation are shown in Table 4. In the table, MMA/TMAEMA represents copolymerization ratio, DMF is dimethylformamide, PC being propylenecarbonate and NMP being N-methylpyrolidone.

TABLE 4

| Gel | A | B | C | D | E |
|---|---|---|---|---|---|
| Polymer | α | α | α | β | γ |
| Monomer ratio 7.8/1.0 in copolymer (MMA/TMAEMA) | 18.6/1.0 | 18.6/1.0 | 18.6/1.0 | 12.3/1.0 | |
| plasticizer | DMF | PC | NMP | NMP | NMP |
| Ionic conductivity (S $cm^{-1}$) | $3.4 \times 10^{-4}$ | $1.2 \times 10^{-6}$ | $2.0 \times 10^{-4}$ | $1.1 \times 10^{-4}$ | $5.8 \times 10^{-5}$ |
| Transference number | 0.63 | 0.59 | 0.61 | 0.66 | 0.72 |

The gel A formed by using dimethylformamide tended to lack electrochemical stability. Phenomena were observed that a potential difference between two pieces of lithium metal foils holding the set impedance measurement cell had occurred and the difference had changed with time. It is believed that these phenomena are due to a reaction whatsoever occurred between dimethylformamide and the lithium electrode. Such phenomena were not observed in other gels B–E.

In addition, it is thought that the gel formed by using propylenecarbonate is excellent in electrochemical stability because it showed no changes in electric resistance ($4.9\times 10^4\Omega$) after and before the measurement of the transference number. However, the ionic conductivity was not so high. It is believed that this is because the viscosity at 25° C. of propylenecarbonate (2.5 cP) is higher than that of dimethylformamide (0.80 cP).

On the other hand, when the effect of a copolymerization ratio on ionic conductivity of a gel is considered, a decrease in ionic conductivity is found in gels formed by using a polymer having high content ratio of methacrylate 2-(trimethylamino)ethyl iodide. It is believed that this is because the gel becomes solid due to increased cross-linking caused by the increase of trimethlyamino ($N^+(CH_3)_3$) contained in a polymer which, as a result, makes difficult the migration of solvation ion comprising lithium ion or lithium and solvent.

In addition, the flexibility of said gels A–E was determined by a sensory test using a pincette separately and the results showed that these gels had almost the same flexibility as that of conventional high molecular solid electrolytes and therefore were fully applicable not only to electrolytes for button-type cells or electrode materials but also to conductive materials for cylindrical cells.

Figure 12:
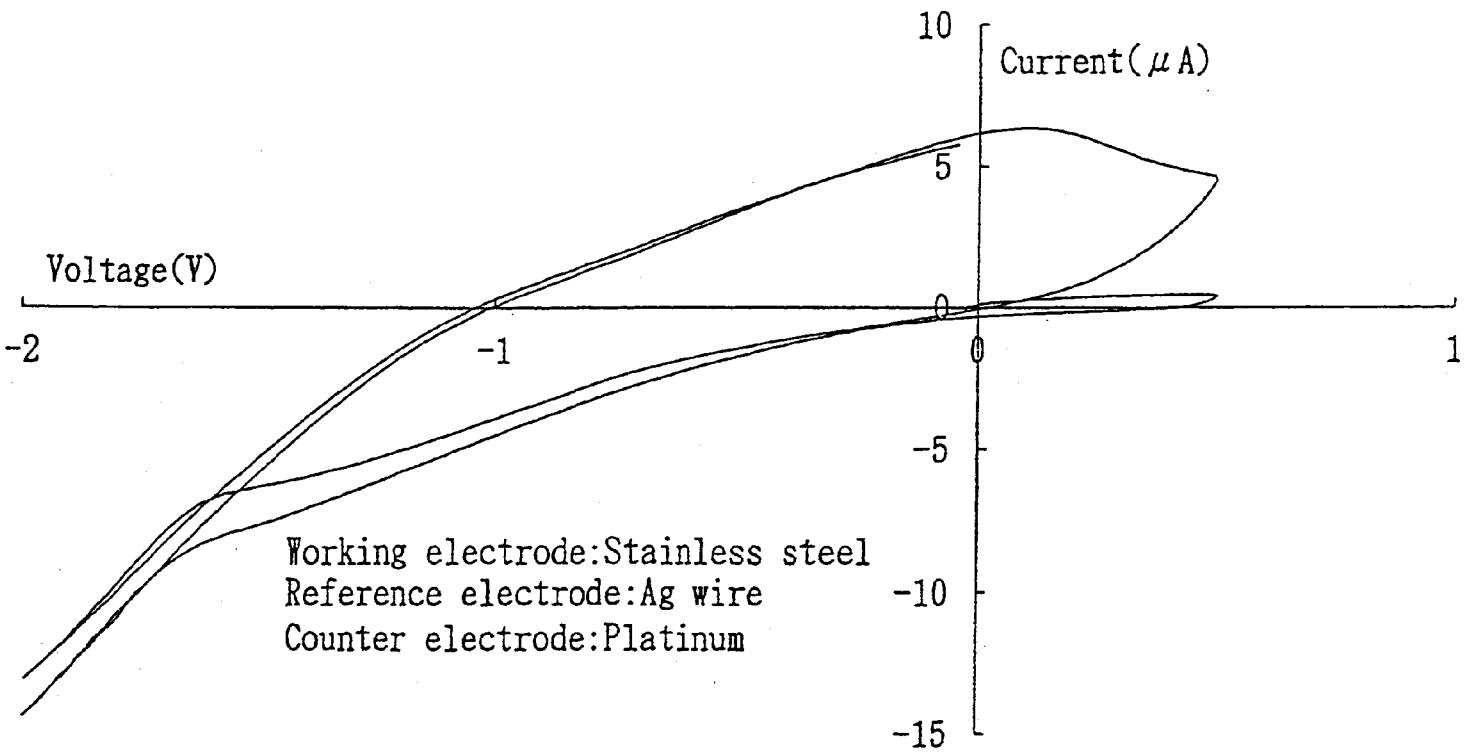
FIG. 12 shows a cyclic voltammogram of gel B.
Figure 13:
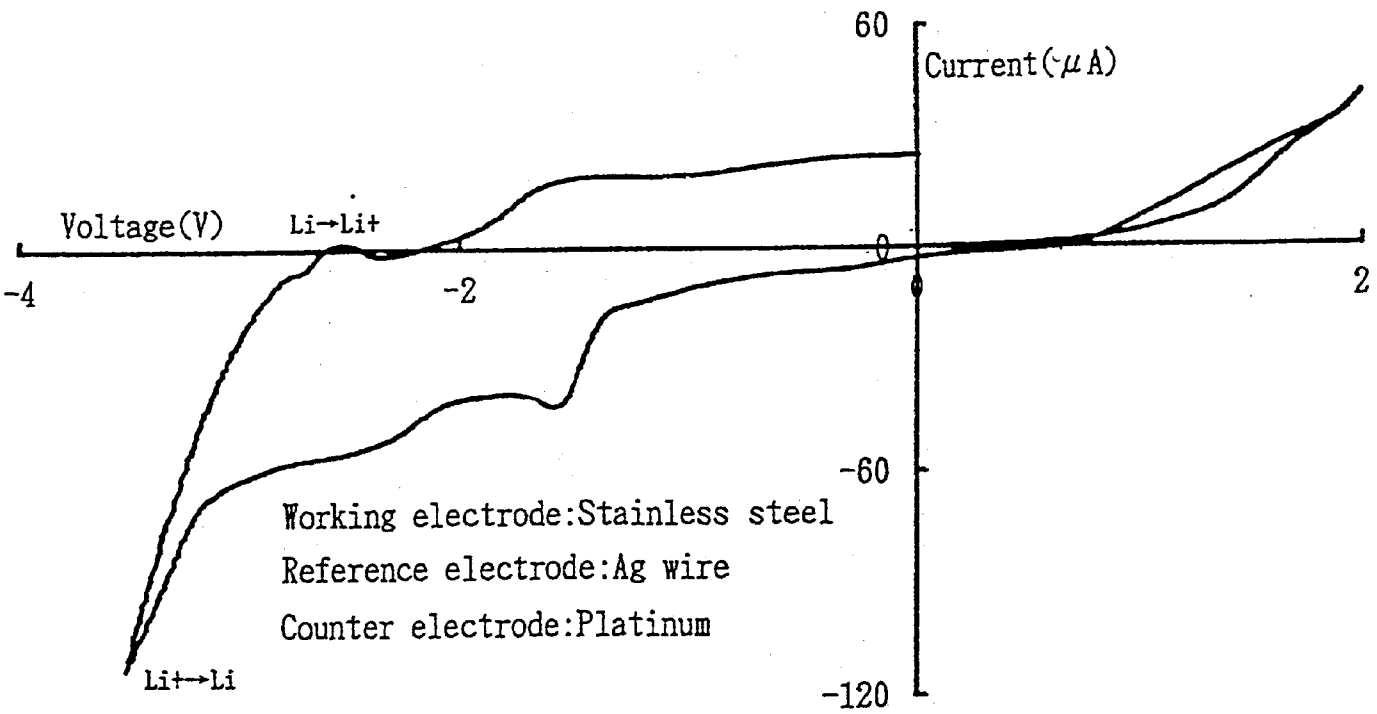
FIG. 13 shows a cyclic voltammogram of gel C.

Moreover, cyclic voltammograms of these gels A–E were plotted for analysis. In this cyclic voltammetry, a cell comprising stainless steel used as a working electrode, Ag wire as a reference electrode and platinum as a counter electrode was used. The scanning speed was 20 mV/sec. The cell was assembled within a dry box in an atomosphere of argon. FIG. 12 shows the results from the analysis using the polymer B and FIG. 13 showing those using the polymer C. As shown in FIG. 12, the crossing is seen at about −1.6V. The deposition and dissolution of metal lithium were confirmed.

On the other hand, as shown in FIG. 13, the deposition of lithium metal was observed at about −3.0V and the dissolution of lithium metal at about −2.2V. These results showed that the gel C is electrochemically stable as a lithium ion conductor.

Example 2

Example of the Use of methylmethacrylate.4-vinylpyridine Copolymers

The methylmethacrylate.4-vinylpyridinemethyl iodide copolymer immobilized by lithiumsiloxyaluminate was prepared to be used as Example 2.

Synthesis of methylmethacrylate.4-vinylpyridine Copolymer 200 mmol of methylmethacrylate (with polymerization inhibitors removed by vacuum distillation), 10 mmol of 4-vinylpyridine, 1 mmol of α,α'-azobis(isobutyronitrile) and 50 ml of tetrahydrofuran were placed into a 100 ml flask and the mixture was then heated at 60° C. to allow a reaction. The reaction solution was added dropwise to 200 ml of methanol to allow a deposition of the reactant. By twice washing with 100 ml of methanol followed by vacuum drying, milk white methylmethacrylate.4-vinylpyridine copolymer was obtained.

To Make Copolymer Quaternary 10 g of said methylmethacrylate.4-vinylpyridine copolymer was placed into a 200 ml flask and 100 ml of acetone was added to dissolve therein, and 15 mmol of methyl iodide was added dropwise slowly to allow the reaction at a room temperature for 2 hours. Then, the reaction solution was added dropwise to 100 ml of hexane to allow the deposition of quaternary copolymer. By twice washing with 50 ml of hexane followed by vacuum drying, yellow solid quaternary copolymer (quaternary organic high molecular compounds) was obtained.

Immobilization by lithiumsiloxyaluminate

Said quaternary organic high molecular compound was immobilized by the same lithiumsiloxyaluminate that was used in Example 1. Said 3 g of quaternary organic high molecular produced from methylmethacrylate.4-vinylpyridine copolymer by methyl iodide was put into a 200 ml flask and 15 ml of dimethylformamide was added to allow the dissolution in an atmosphere of argon. To this solution, another solution in which 2.5 g of lithiumsiloxyaluminate was dissolved in 15 ml of dimethylformamide in a separate 200 ml flask was added dropwise to allow a reaction at a room temperature for 2 hours. The reaction solution was added dropwise to 100 ml of acetone to allow a deposition. By washing twice the deposited substance with 50 ml of acetone, immobilized lithiumsiloxyaluminate was obtained.

A gel was formed by using said immobilized lithiumsiloxyaluminate and N-methylpyrolidone which is seven times larger by weight than the former in the same manner as in Example 1. The ionic conductivity and transference number of the formed gel were determined in the same manner as in Example 1. Its ionic conductivity was $3.9\times10^{-4}$ $Scm^{-1}$ and its transference number was 0.58, which showed that an excellent conductive material could be obtained by using methylmethacrylate.4-vinylpyridine copolymer as in the case of using MMA-TMAEMA. The flexibility of this conductive material at the time of handling was as good as that of material obtained in Example 1.

Example 3

Example of the Use of N,N-dialkylalkenylamide Polymer

Synthesis of N,N-dimethylacrylamide.methacrylate 2-dimethylaminoethyl Copolymer

N,N-dimethylacrylamide (referred to as "DMAA") and methacrylate 2-dimethylaminoethyl were placed into a flask in an atmosphere of argon so that the mole ratio of the former to the latter was 5:1and tetrahydrofuran was added. To the mixture, α,α'-azobis(isobutyronitrile) (AIBN) was added so that its mixing ratio to said methacrylate 2-dimethylaminoethyl was 5 mmol:1 mol and allowed to react at a temperature of 60° C. for 5 hours. Then, cooling by liquid nitrogen and subsequent pressure reduction were repeated to remove oxygen from monomers and tetrahydrofuran. By dropwise addition of anhydrous hexane and by decantation, N,N-dimethylacrylamide.methacrylate 2-dimethylaminoethyl copolymer was obtained.

Synthesis of N,N-dimethylacrylamide.methacrylate 2-trimethylaminoethyl iodide Copolymer The obtained N,N-dimethylacrylamide.methacrylate.2-trimethylaminoethyl copolymer was placed in an atmosphere of argon and anhydrous acetone was added so that a mole ratio of methacrylate 2-trimethylaminoethyl unit to anhydrous acetone was 1:8 and the mixture was stirred to allow dissolution. Then, a solution in which methyl iodide was dissolved in acetone was added so that a mole ratio of methacrylate 2-dimethylaminoethyl unit to methyl iodide was 1:3 and the mixture was maintained at a temperature of 60° C. for 3 hours to allow a reaction to make the copolymer quaternary compounds and a precipitate was removed and vacuum drying at a temperature of 90° C. to obtain N,N-dimethylacrylamide.methacrylate 2-trimethylaminoethyl iodide copolymer.

Immobilization by lithiumsiloxyaluminate

Figure 14:
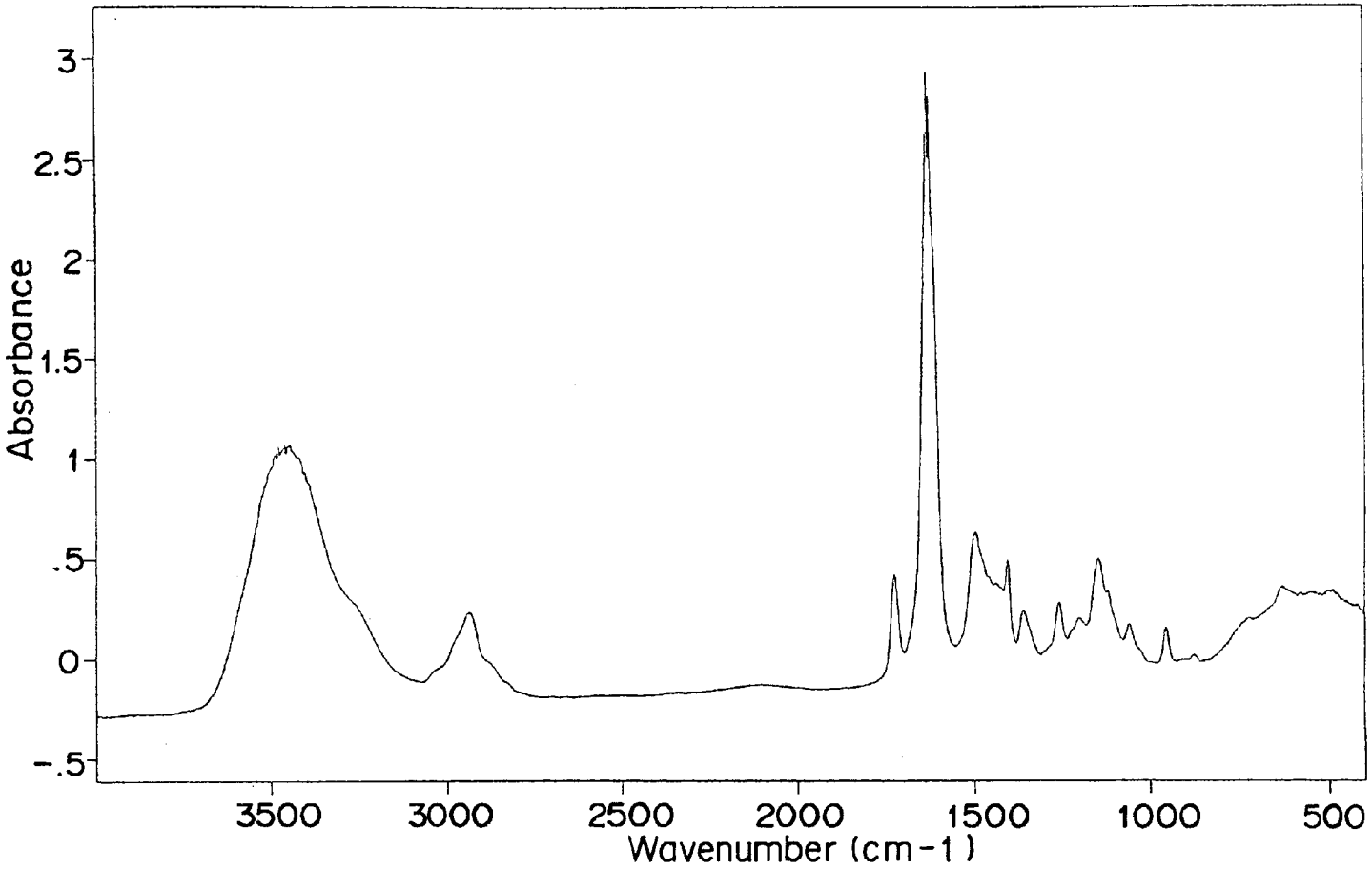
FIG. 14 illustrates infrared absorption spectra of N,N-dimethylacrylamide.methacrylate 2-(dimethylamino)ethyl copolymer.

The obtained N,N-dimethylacrylamide.methacrylate 2-trimethylaminoethyl iodide copolymer and lithiumsiloxyaluminate prepared in the same manner as in Example 1 was added, in an atmosphere of argon, to dimethylformamide so that a mole ratio of methacrylate 2-dimethylaminoethyl unit to dimethylformamide was 1:4 and the mixture was stirred at a temperature of 25° C. for 3 hours to allow the quaternary copolymer to be immobilized by lithiumsiloxyaluminate. A small amount of the solution was pipetted and to the solution, acetone, hexane, and methanol was respectively added to determine which solvent formed a precipitate and the plasticizer,that formed a precipitate was added to TMAEMA so that a mole ratio of TMAEMA unit to the plasticizer was 1:10 to form a precipitate. Vacuum drying of the precipitate at 90° C. was performed to use for synthesis. The quaternary polymer immobilized by lithiumsiloxyaluminate is hereafter referred to as "conductive material a" (Example 3). In the above Example, N,N-dimethylacrylamide and methacrylate 2-dimethylaminoethyl, both being materials for a copolymer, were used so that its mole ratio of the former to the latter was 5:1. In addition, by making above mole ratio be 10:1, a copolymer of N,N-dimethylacrylamide.methacrylate 2-dimethylaminoethyl (IR spectra of this is shown in FIG. 14 and $^1$H-NMR spectra using DMF-$d_7$ as solvent in FIG. 15) was synthesized and made a quaternary compound. Then, the quaternary compound was added to dimethylformamide so that mole ratio of TMAEMA unit of the copolymer to lithiumsiloxyaluminate was 1:4 and immobilized by lithiumsiloxyaluminate to obtain a "conductive material b". (IR spectra of this material b was shown in FIG. 16 and its $^1$H-NMR spectra using DMF-$d_7$ as solvent in FIG. 17).

As shown in FIG. 14, the material exhibits absorptions due to C═O bonding at the wave numbers of about 1700 $cm^{-1}$, absorptions due to —O— bonding at 1000–1300 $cm^{-1}$, absorptions due to amines at about 3400 $cm^{-1}$, however, it did not exhibit strong absorptions due to alkenes at about 900 $cm^{-1}$.

Figure 15:
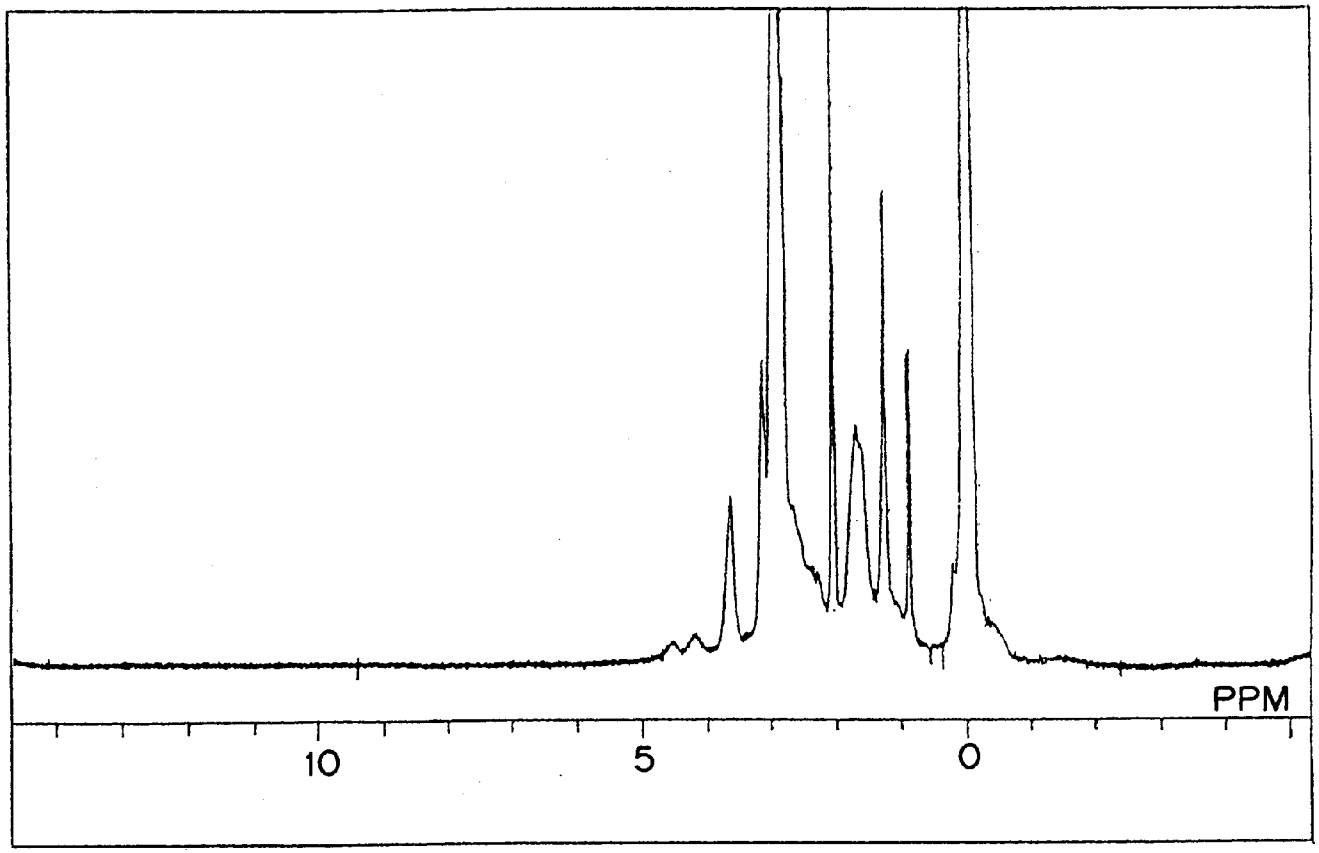
FIG. 15 illustrates $^{1}$H-NMR spectra of N,N-dimethylacrylamide.methacrylate 2-(dimethylamino)ethyl copolymer.

In FIG. 15, a peak due to $CH_3$—N bonding centers at 2.3 ppm, peak due to $CH_3$—C bonding at 0.8–1.1 ppm, peak due to $CH_2$—C bonding at 2.0 ppm, peak due to —$CH_2$—N bonding at 2.5–2.6 ppm, peak due to —$CH_2$—C bonding at 4.1 ppm and peak due to —CH— bonding at 2.4 ppm. Other peaks show impurities.

In addition, a CHNS/O elemental analysis was performed. Table 5 shows results including both measured and theoretical values. The calculation based on these values showed that an existing mole ratio of N,N-dimethylacrylamide unit to methacrylate 2-(dimethylamino)ethyl unit was 8.7:1.

Moreover, the measurement using GPC equipment HLC802A (TOSOH Corp.) showed that the average molecular weight of a copolymer of N,N-dimethylacrylamide.methacrylate 2-dimethylaminoethyl was 200000.

TABLE 5

| | C | H | N | O |
|---|---|---|---|---|
| Measured value (%) | 60.79 | 9.14 | 13.36 | 16.80 |
| Theoretical value (%) | 60.68 | 9.15 | 13.43 | 16.74 |

Figure 16:
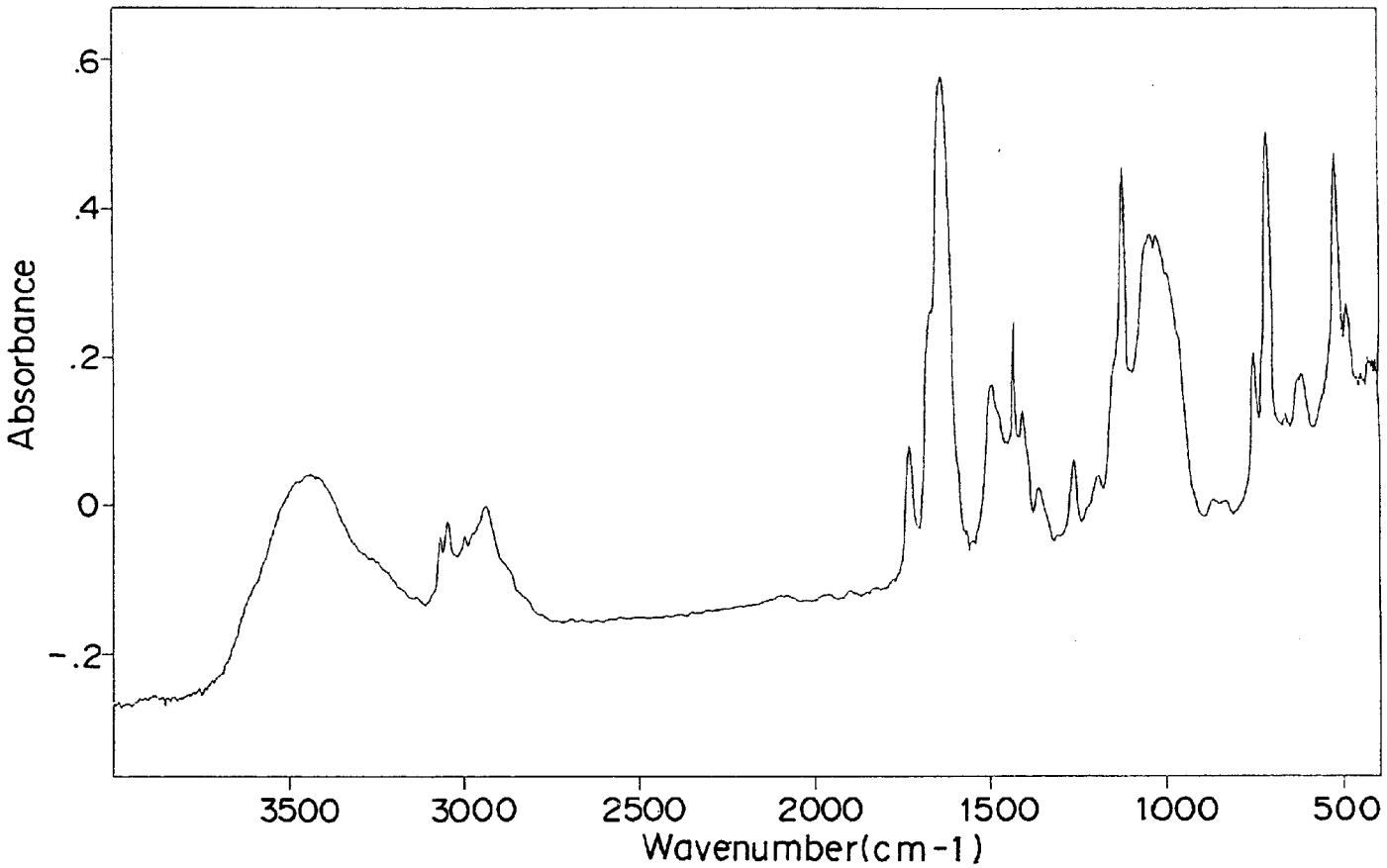
FIG. 16 illustrates infrared absorption spectra of N,N-dimethylacrylamide.methacrylate 2-(dimethylamino)ethyl copolymer chemically bound to lithiumsiloxyaluminate.

On the other hand, as shown in FIG. 16, the material exhibits absorptions due to C═O bonding at the wave numbers of about 1700 $cm^{-1}$, absorptions due to —O— bonding at 1000–1300 $cm^{-1}$, absorptions due to amines at about 3400 $cm^{-1}$, absorptions due to aromatic compounds at about 1420 $cm^{-1}$ and 1120 $cm^{-1}$, absorptions due to Si—O at 900–1100 $cm^{-1}$, absorptions due to substituent aromatic compounds at about 700 $cm^{-1}$ and absorptions due to $Si(C_6H_5)_2$ at about 520 $cm^{-1}$.

Figure 17:
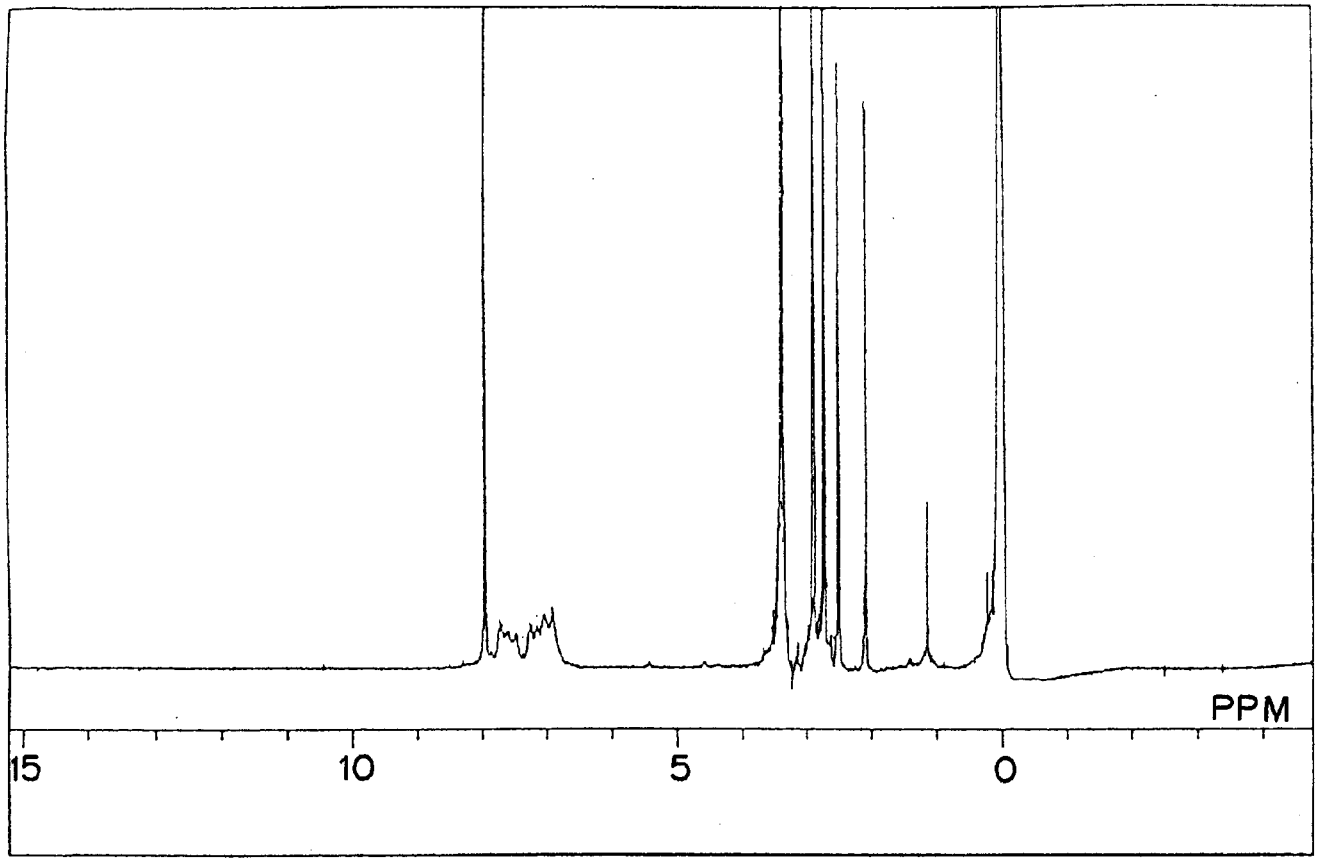
FIG. 17 illustrates $^{1}$H-NMR spectra of N,N-dimethylacrylamide.methacrylate 2-(dimethylamino)ethyl copolymer chemically bound to lithiumsiloxyaluminate.

In FIG. 17, a peak due to $CH_3$—N bonding centers at 2.2–2.3 ppm, peak due to $CH_3$—C bonding at 0.8–1.1 ppm, peak due to —$CH_2$—C bonding at 1.8–2.0, peak due to —$CH_2$—N bonding at 2.5–2.6 ppm, peak due to —$CH_2$—O bonding at 4.0–4.1 ppm and peak due to —CH— bonding at 2.4 ppm and $(C_6H_5)$— structure at 6.8–7.2 ppm. Other peaks show impurities.

In addition, an ICP (inductively coupled plasma) analysis and CHNS/O elemental analysis were performed. Table 6 shows results including both measured and theoretical values. The calculation based on these values showed that an existing mole ratio of N,N-dimethylacrylamide unit to methacrylate 2-(dimethylamino)ethyl unit and to lithiumsiloxyaluminate unit was 8.7:1:3.8. The measurement using GPC equipment HLC802A (TOSOH Corp.) showed that the average molecular weight of this conductive material was 220000.

TABLE 6

| | Al | Li | Si | C | H | N | O |
|---|---|---|---|---|---|---|---|
| Measured value (%) | 3.71 | 0.94 | 7.71 | 61.72 | 6.09 | 4.90 | 14.93 |
| Theoretical value (%) | 3.77 | 0.98 | 7.85 | 61.74 | 6.03 | 4.74 | 14.89 |

These two kinds of conductive materials were mixed with the plasticizer (hereinafter as "EC:PC") in which ethylene carbonate was mixed with propylenecarbonate in equal volume or the plasticizer (hereinafter as "EC:DMC") in which ethylene carbonate was mixed dimethylcarbonate in equal volume so that the mixing ratio of each material to each of the said plasticizer was 3:7 (by weight) and the mixture was gelled by ultrasonic shaking.

The obtained gels are found to have high handling properties and to be fully usable as not only materials for electrolytes of button-type cells or for electrodes but also conductive materials for cylindrical cells.

The ionic conductivity and transference number of these gels were determined in the same manner as in the Example 1. Table 7 shows their results. In the Table, "DMAA/TMAEMA" represents a mole ratio (at the time of preparation) of N,N-methylacrylamide (DMAA) to methacrylate 2-trimethylaminoethyl iodide in the N,N-dimethylacrylamide.methacrylate 2-trimethylaminoethyl iodide copolymer prior to copolymerization.

TABLE 7

| Monomer ratio in copolymer (DMMA/TMAEMA) | 4.8/1 | | 8.7/1 | |
|---|---|---|---|---|
| plasticizer | EC:PC | EC:DMC | EC:PC | EC:DMC |
| Ionic conductivity (S $cm^{-1}$) | $1.48 \times 10^{-4}$ | $1.55 \times 10^{-6}$ | $2.28 \times 10^{-4}$ | $2.46 \times 10^{-4}$ |
| Transference number | 0.50 | 0.54 | 0.53 | 0.59 |

Table 7 shows that conductive materials of the present invention obtained by immobilization of N,N-dimethylacrylamide.methacrylate 2-trimethylaminoethyl iodide copolymer by lithiumsiloxyaluminate have excellent ionic conductivity and high transference numbers.

Example 4

Example of the Use of N,N-alkylalkenylamide Polymer

Synthesis of N-isopropylalkenylamide.methacrylate 2-dimethylaminoethyl Copolymer In the same manner as in the Example 3, N-isopropylacrylamide.methacrylate 2-dimethylaminoethyl copolymer was obtained by using N-isopropylacrylamide (hereinafter "NIPAM") instead of N,N-dimethylacrylamide that was used for the synthesis of N,N-dimethylacrylamide.methacrylate 2-dimethylaminoethyl copolymer in the Example 3. The mole ratio of N-isopropylacrylamide to 2-dimethylaminoethyl at the time of preparation was 5:1. The IR spectra of this material is shown in FIG. 18 and its $^1$H-NMR spectra using DMF-$d_7$ as solvent in FIG. 19.

Figure 18:
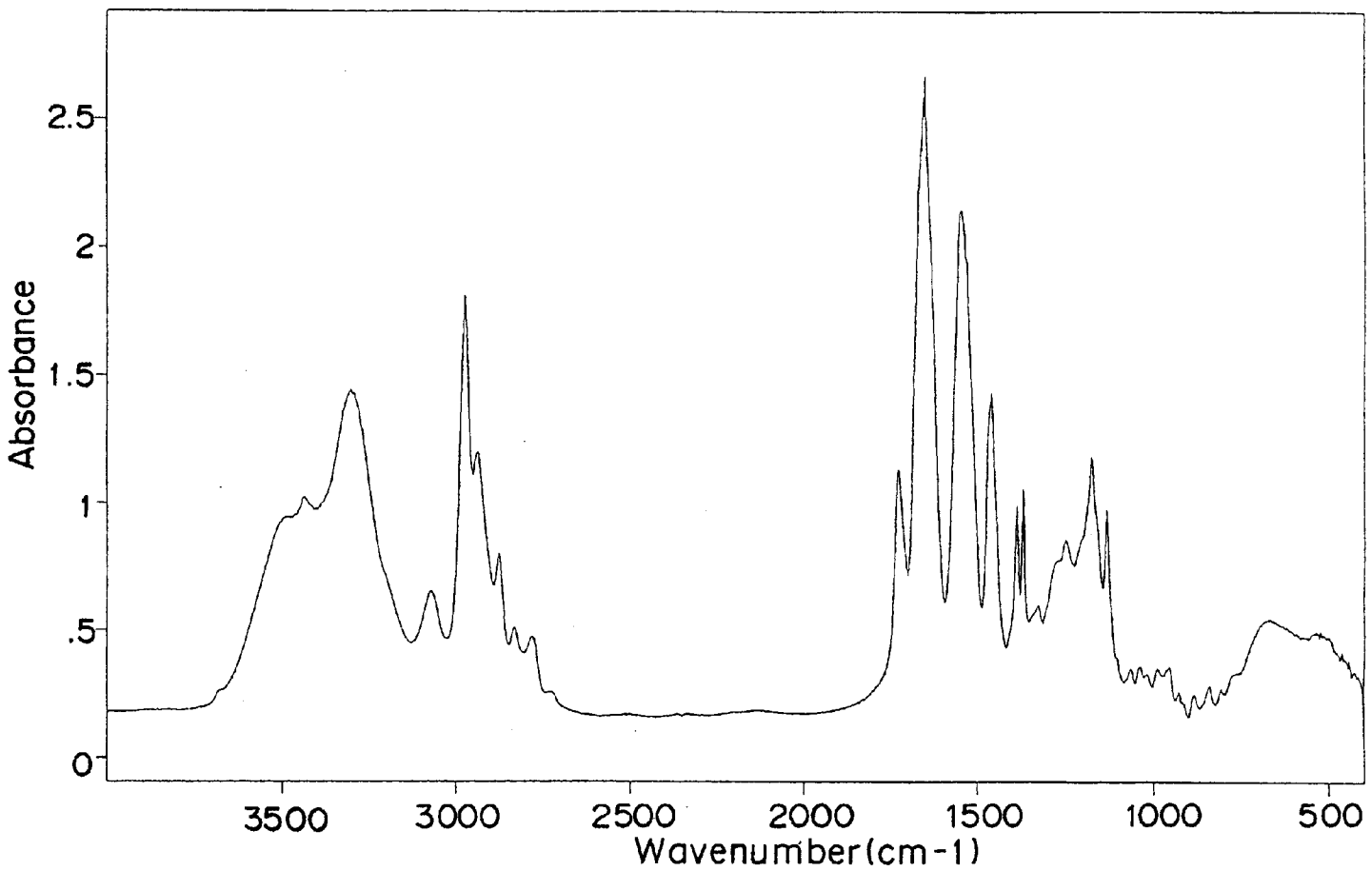
FIG. 18 illustrates infrared absorption spectra of N-isopropylacrylamide.methacrylate 2-(dimethylamino) ethyl copolymer.

As shown in FIG. 18, the material exhibits absorptions due to C═O bonding at the wave numbers of about 1700 $cm^{-1}$, absorptions due to —O— bonding at 1000–1300 $cm^{-1}$, absorptions due to amines at about 3400 $cm^{-1}$, however, it did not exhibit strong absorptions due to alkenes at about 900 $cm^{-1}$.

Figure 19:
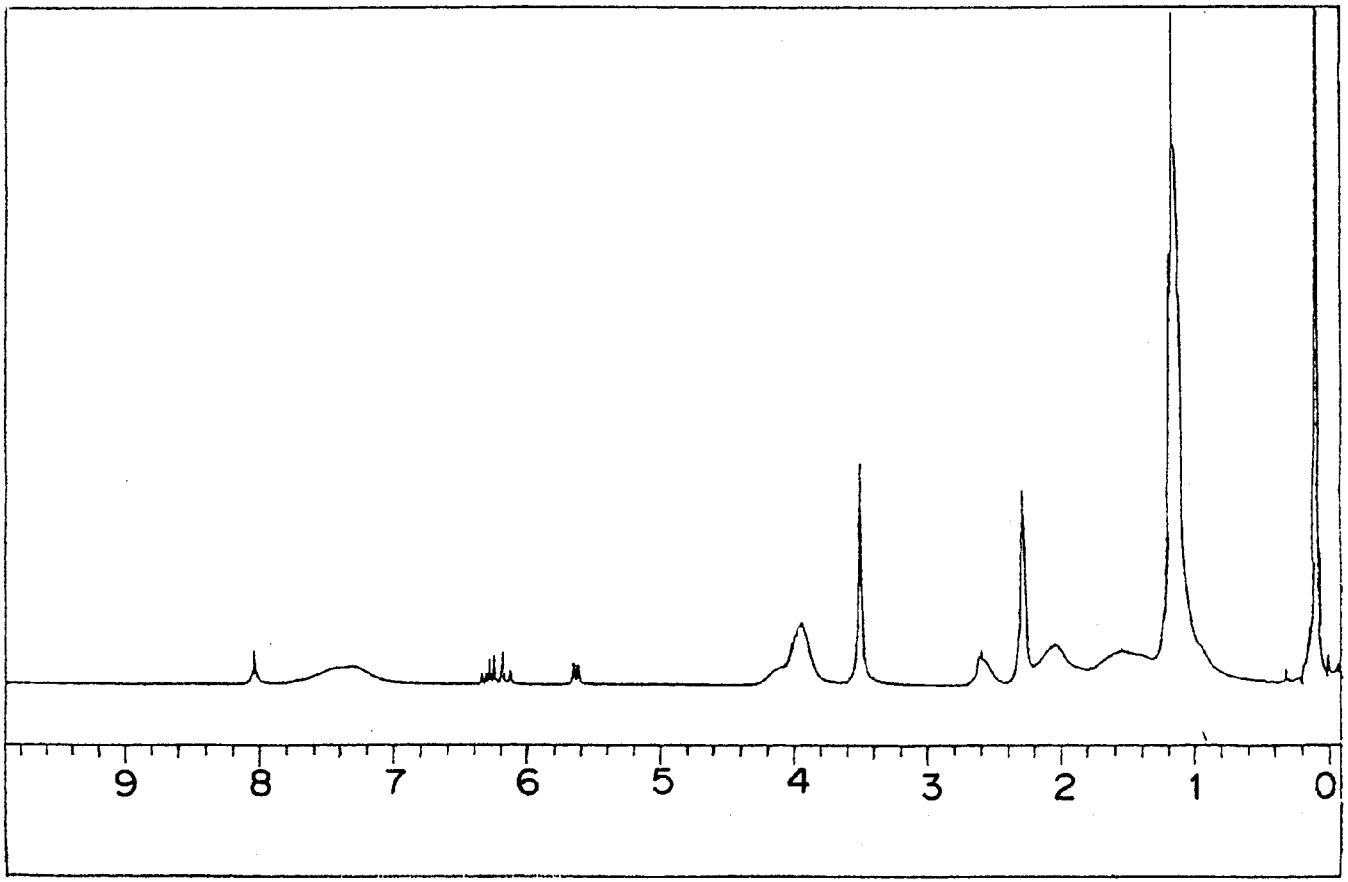
FIG. 19 illustrates $^{1}$H-NMR spectra of N-isopropylacrylamide.methacrylate 2-(dimethylamino) ethyl copolymer.

In FIG. 19, a peak due to $CH_3$—O bonding centers at 3.6 ppm, peak due to $CH_3$—N bonding at 2.3 ppm, peak due to $CH_3$—C bonding at 0.8–1.1 ppm, peak due to —$CH_2$—C bonding at 2.0 ppm, peak due to —$CH_2$—N bonding at 2.5–2.6 ppm and peak due to —$CH_2$—C bonding 4.1 ppm, peak due to —CH— bonding at 2.4 ppm, and peak due to —NH— at 7.8–8.2 ppm. Other peaks show impurities.

In addition, an ICP (inductively coupled plasma) analysis and CHNS/O elemental analysis were performed. Table 8 shows results including both measured and theoretical values. The calculation based on these values showed that an existing mole ratio of N-isopropylacrylamide unit to 2-dimethylaminoethyl unit was 4.4:1. The measurement using GPC equipment HLC802A (TOSOH Corp.) showed that the average molecular weight of this conductive material was 250000.

TABLE 8

| | C | H | N | O |
|---|---|---|---|---|
| Measured value (%) | 65.76 | 8.95 | 10.80 | 14.49 |
| Theoretical value (%) | 63.16 | 9.70 | 11.63 | 15.51 |

To Make Copolymer Quaternary

Said N-isopropylacrylamide.methacrylate 2-dimethylaminoethyl copolymer was made quaternary in the same manner as Example 3.

Immobilization by lithiumsiloxyaluminate

The obtained N-isopropylacrylamide.methacrylate 2-dimethylaminoethyl copolymer was immobilized by lithiumsiloxyaluminate which had been prepared by the same method as in Example 1, in the same manner as in Example 3, except that,it was stirred at a temperature of 20° C. for a hour, instead of 60° C. for 5 hours. The IR spectra of this material is shown in FIG. 20 and its $^1$H-NMR spectra using DMF-$d_7$ as solvent in FIG. 21.

Figure 20:
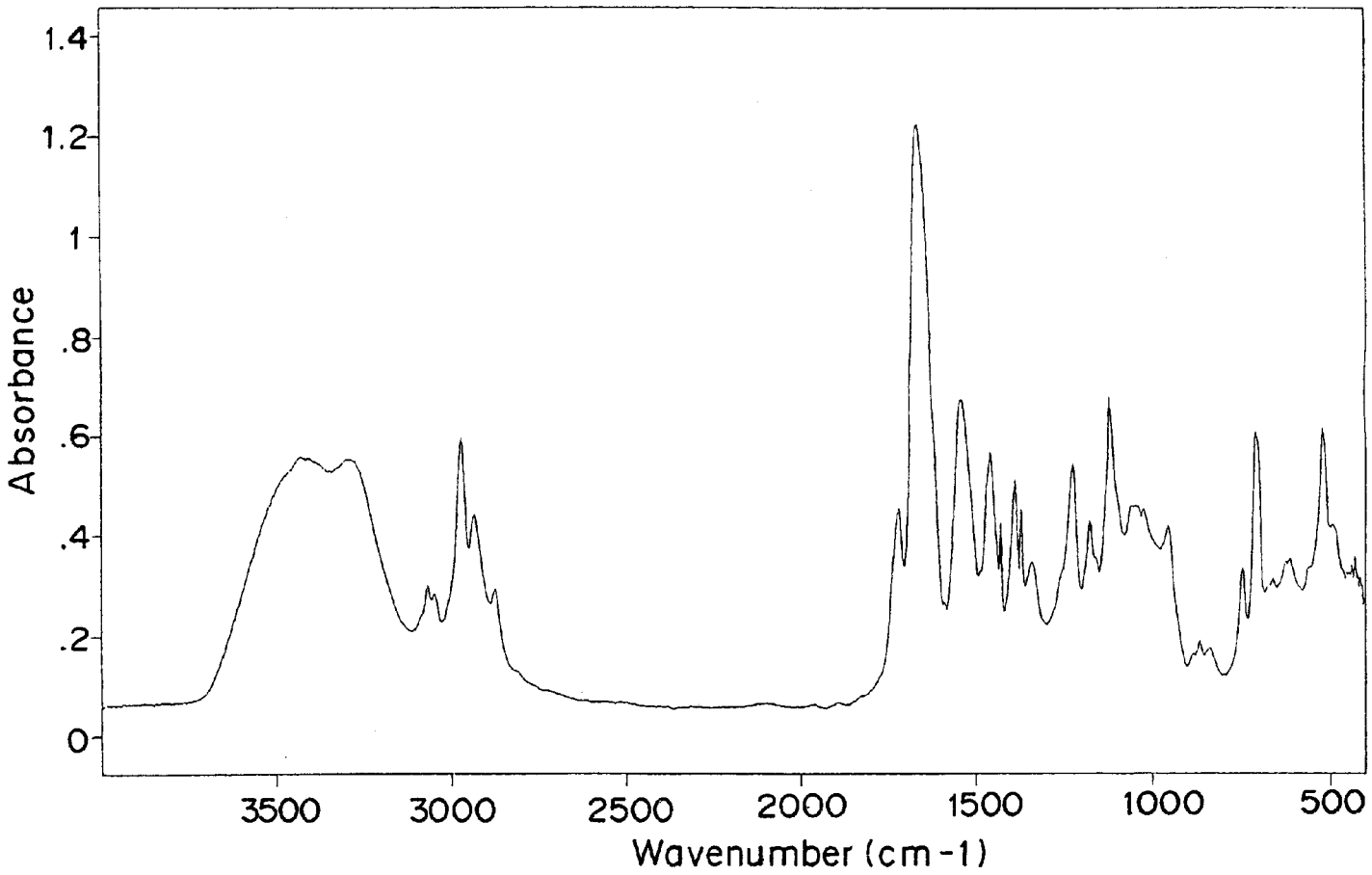
FIG. 20 illustrates infrared absorption spectra of N-isopropylacrylamide.methacrylate 2-(dimethylamino) ethyl copolymer chemically bound to lithiumsiloxyaluminate.

As shown in FIG. 20, the material exhibits absorptions due to C═O bonding at the wave numbers of about 1700 $cm^{-1}$, absorptions due to —O— bonding at 1000–1300 $cm^{-1}$, absorptions due to amins at about 3400 $cm^{-1}$, absorptions due to aromatic compounds at about 1420 and 1120 $cm^{-1}$, absorptions due to Si—O at 900–1100 $cm^{-1}$, absorptions due to substituent aromatic compounds at about 700 $cm^{-1}$ and absorptions due to $Si(C_6H_5)_2$ at about 520 $cm^{-1}$.

Figure 21:
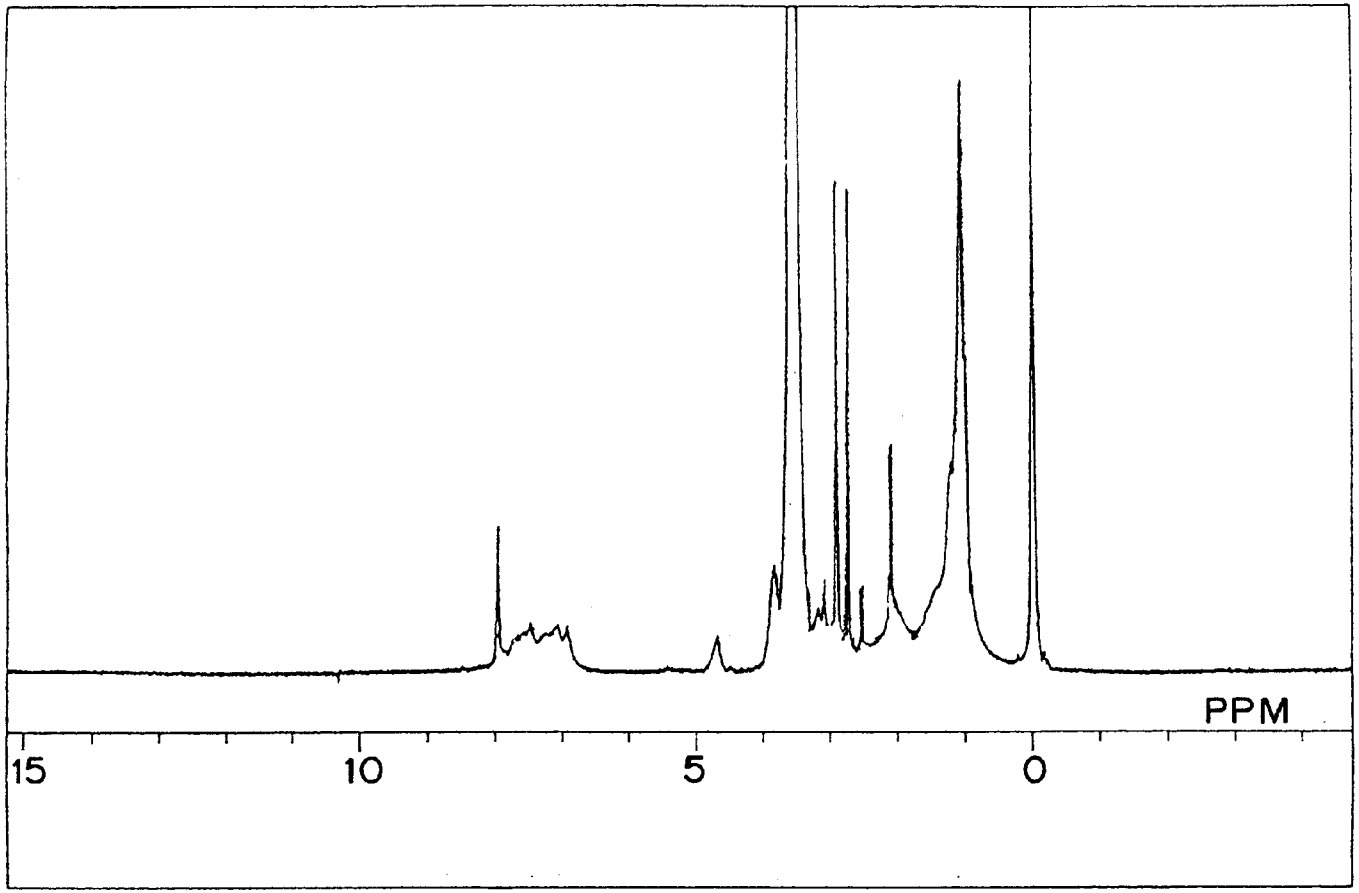
FIG. 21 illustrates $^{1}$H-NMR spectra of N-isopropylacrylamide.methacrylate 2-(dimethylamino) ethyl copolymer chemically bound to lithiumsiloxyaluminate.

In FIG. 21, a peak due to $CH_3$—O bonding centers at 3.5–3.7 ppm, peak due to $CH_3$—N bonding at 2.2–2.3 ppm, peak due to $CH_3$—C bonding at 0.8–1.1 ppm, peak due to —$CH_2$—C bonding at 1.8–2.0 ppm, peak due to —$CH_2$—N bonding at 2.5–2.6 ppm, peak due to —$CH_2$—O— bonding at 4.0–4.1 ppm, peak due to —CH— bonding at 2.4 ppm, peak due to —NH— bonding at 7.8–8.2 ppm, and peak due to $(C_6H_5)$— structure at 6.8–7.2 ppm. Other peaks were due to impurities.

In addition, an ICP (inductively coupled plasma) analysis and CHNS/O elemental analysis were performed. Table 9 shows results including both measured and theoretical values. The calculation based on these values showed that an existing mole ratio of N-isopropylacrylamide unit to 2-dimethylaminoethyl unit and to lithiumsiloxyaluminate unit was 4.4:1:3.5. The measurement using GPC equipment HLC802A (TOSOH Corp.) showed that the average molecular weight of this conductive material was 300000.

TABLE 9

| | Al | Li | Si | C | H | N | O |
|---|---|---|---|---|---|---|---|
| Measured value (%) | 4.14 | 1.08 | 8.61 | 63.31 | 5.67 | 3.15 | 14.04 |
| Theoretical value (%) | 4.23 | 1.10 | 8.81 | 63.26 | 5.60 | 3.00 | 14.00 |

Formation of Gels and Evaluation

A gel was formed by using said N-isopropylacrylamide.methacrylate 2-trimethylaminoethyl iodide copolymer immobilized by lithiumsiloxyaluminate. The plasticizer used for the formation was dimethlyformamide (hereafter "DMF"), N-methyl-2-pyrolidone hereafter "NMP"), γ-butyrolactone (hereafter "γBL"), mixture plasticizer if ethylene carbonate and propylenecarbonate in equal volume (hereafter EC:PC), mixture plasticizer of ethylenecarbonate and dimethylcarbonate in equal volume (hereafter EC:DMC), mixture plasticizer of ethylenecarbonate and diethylcarbonate in equal volume (hereafter EC:DEC), propylenecarbonate (hereafter "PC"). The said iodide copolymer was mixed with each of these plasticizer so that the by-weight mixing ratio of the former to the latter was 3:7 and each mixture was gelled by ultrasonic shaking.

These gels were found to have high handleability and to be satisfactorily usable not only as materials for electrolytes of button-type cells or for electrodes but also as conductive materials for cylindrical cells.

The evaluation of each conductive material comprising each gel was performed in the same manner as in the example 1. The results are shown in Table 10.

TABLE 10

| Used plasticizer | Ionic conductivity ($\times 10^{-4}$Scm$^{-1}$) | Transference number |
|---|---|---|
| DMF | 3.11 | 0.54 |
| NMP | 2.88 | 0.55 |
| γBL | 2.82 | 0.58 |
| EC:PC | 2.31 | 0.55 |
| EC:DEC | 2.83 | 0.57 |
| EC:DMC | 2.20 | 0.58 |
| PC | 1.33 | 0.60 |
| (Ratio of monomer unit in copolymers (NIPAM:TMAEMA) = 4.4:1) | | |

For the purpose of comparison, a conductive material obtained by immobilizing MMA-TMAEMA by lithiumsiloxyaluminate was dissolved in the same plasticizer used above at the same mixing ratio of the conductive material to each plasticizer as above and used for evaluation. The results are shown in Table 11. The conductive material obtained by immobilizing MMA-TMAEMA by lithiumsiloxyaluminate was the same as in Example 1 except that the mixing ratio of material was changed and finally the existing mole ratio of methacrylatemethyl unit to methacrylate 2-(tetramethylamino)ethyl unit and to lithiumsiloxyaluminate unit was 4.5:1:3.6.

Thus, a reaction of immobilizing MMA-TMAEMA by lithiumsiloxyaluminate is found to require a higher temperature and longer time compared with that of immobilizing N-isopropylacrylamide.methacrylate 2-trimethylaminoethyl iodide copolymer by lithiumsiloxyaluminate.

Chemical formula 4 shows the conductive material obtained by using above iodide copolymer, where the ratio of α:β:γ is 5:1:4 at the time of preparation, but the ratio obtained by the actual analysis was 4.4:1:3.5 as described above.

TABLE 11

| Used plasticizer | Ionic conductivity ($\times 10^{-4}$Scm$^{-1}$) | Transference number |
|---|---|---|
| DMF | 2.95 | 0.56 |
| NMP | 0.84 | 0.55 |
| γBL | 0.411 | 0.61 |
| EC:PC | 0.31 | 0.58 |
| EC:DEC | 0.20 | 0.59 |
| EC:DMC | 0.20 | 0.60 |
| PC | 0.012 | 0.65 |
| (Ratio of monomer unit in copolymers (MMA:TMAEMA) = 4.5:1) | | |

Tables 10 and 11 show that, when compared with the conductive material obtained by immobilizing MMA-TMAEMA by lithiumsiloxyaluminate, the conductive material comprising N-isopropylacrylamide.methacrylate 2-trimethylaminoethyl iodide copolymer with lithiumsiloxyaluminate immobilized, though the transference numbers of both materials are similar, has a higher ionic conductivity and is more excellent.

Table 10 shows data on the conductive material having the ratio of α:β:γ shown in the Chemical formula 4 being 5:1:4 (mole ratio at the time of preparation). Similarly, conductive materials having this ratio being 1:1:4 and 10:1:4 were synthesized by changing their preparation ratio of each material in the same manner. Their gels were formed by various organic solvent and were evaluated. Table 12 shows evaluation results of gels comprising conductive materials having the mole ratio at the time of preparation being 1:1:4 (the actual analysis showed that the mole ratio was 1.2:1:3.9). Table 13 shows evaluation results of gels comprising conductive materials having the mole ratio at the time of preparation being 10:1:4 (the actual analysis showed that the mole ratio was 9.2:1:3.6).

Moreover, these gels were found to have sufficient flexibility required to be used as a material for cells.

TABLE 12

| Used plasticizer | Ionic conductivity ($\times 10^{-4}$Scm$^{-1}$) | Transference number |
|---|---|---|
| DMF | 2.95 | 0.55 |
| NMP | 2.48 | 0.58 |
| γBL | 2.41 | 0.57 |
| EC:PC | 2.23 | 0.54 |
| EC:DEC | 2.73 | 0.61 |
| EC:DMC | 2.37 | 0.60 |
| PC | 1.25 | 0.64 |
| (Ratio of monomer unit in copolymers (NIPAM:TMAEMA) = 1.2:1) | | |

TABLE 13

| Used plasticizer | Ionic conductivity ($\times 10^{-4}$Scm$^{-1}$) | Transference number |
|---|---|---|
| DMF | 3.59 | 0.48 |
| NMP | 3.08 | 0.51 |
| γBL | 2.61 | 0.58 |
| EC:PC | 2.41 | 0.52 |
| EC:DEC | 2.96 | 0.54 |
| EC:DMC | 2.44 | 0.56 |
| PC | 1.42 | 0.59 |
| (Ratio of monomer unit in copolymers (NIPAM:TMAEMA) = 9.2:1) | | |

Tables 12 and 13 show that excellent conductive materials can be obtained even if the ratio of α:β:γ has been changed.

What is claimed is:

1. An ionic conductive material comprising a high molecular compound and alkalisiloxyaluminate.

2. The conductive material as defined in claim 1 wherein said alkalisiloxyaluminate is lithiumsiloxyaluminate.

3. The conductive material as defined in claim 1 or 2 wherein said high molecular compound is bound by an ionic bond to alkalisiloxyaluminate.

4. The conductive material as defined in claim 1 or 2 wherein said high molecular compound comprises at least one selected from the group consisting of methacrylate polymer, N,N-dialkylalkenylamide polymer and N-isopropylalkenylamide polymer.

5. The conductive material as defined in claim 4 wherein said methacrylatepolymer comprises either of a methylmethacrylate.methacrylate 2-(trimethylamino)ethyl-halide-copolymer and a methylmethacrylate.4-vinylpyridine ethyl halide copolymer, or a mixture of these two copolymers.

6. The conductive material as defined in claim 4 wherein said N,N-dialkylalkenylamide is a N,N-dimethylacrylamide.methacrylate-2-dimethylamino ethyl halide copolymer.

7. The conductive material as defined in claim 4 wherein said isopropylalkenylamide polymer is a N-isopropylacrylamide.methacrylate 2-(trimethylamino) ethyl halide copolymer.

8. A composition for a conductive material comprising high molecular compound and alkalisiloxyaluminate.

* * * * *